US010872482B1

(12) United States Patent
Colton et al.

(10) Patent No.: US 10,872,482 B1
(45) Date of Patent: Dec. 22, 2020

(54) PERSONALIZED LID FOR PRESCRIPTION BOTTLES

(71) Applicants: Alexander Montgomery Colton, Wilmington, DE (US); Joseph William White, Winchester, VA (US)

(72) Inventors: Alexander Montgomery Colton, Wilmington, DE (US); Joseph William White, Winchester, VA (US)

( * ) Notice: Subject to any disclaimer, the term of this patent is extended or adjusted under 35 U.S.C. 154(b) by 0 days.

(21) Appl. No.: 16/198,659

(22) Filed: Nov. 21, 2018

Related U.S. Application Data

(60) Provisional application No. 62/590,052, filed on Nov. 22, 2017.

(51) Int. Cl.

| | |
|---|---|
| ***G07C 9/00*** | (2020.01) |
| ***B65D 41/02*** | (2006.01) |
| ***B65D 50/00*** | (2006.01) |
| ***B65D 55/02*** | (2006.01) |
| ***A61J 1/03*** | (2006.01) |
| ***A61J 7/04*** | (2006.01) |
| ***B65D 47/08*** | (2006.01) |

(52) U.S. Cl.
CPC ..... *G07C 9/00563* (2013.01); *A61J 1/03* (2013.01); *A61J 7/0418* (2015.05); *A61J 7/0436* (2015.05); *A61J 7/0481* (2013.01); *B65D 41/026* (2013.01); *B65D 47/08* (2013.01); *B65D 50/00* (2013.01); *B65D 55/02* (2013.01)

(58) Field of Classification Search
None
See application file for complete search history.

(56) References Cited

U.S. PATENT DOCUMENTS

| | | | |
|---|---|---|---|
| 4,662,537 | A | 5/1987 | Wolf |
| 5,143,785 | A | 9/1992 | Walters, Jr. |

(Continued)

FOREIGN PATENT DOCUMENTS

| | | |
|---|---|---|
| CA | 2589530 | 11/2004 |
| EP | 0370309 | 11/1988 |

(Continued)

OTHER PUBLICATIONS

Never forget a pill again Pillsy Smart Pill Bobble + Mobile App https pillsy.com Oct. 2, 2017.

(Continued)

*Primary Examiner* — K. Wong
(74) *Attorney, Agent, or Firm* — Aldo Noto; Davidson Berquist Jackson & Gowdey, LLP

(57) ABSTRACT

A universal pill bottle cap for securely locking up medications with a high-risk factor for abuse and theft. The pill bottle cap includes a unique locking mechanism, a biometric scanning locking mechanism, a one-step opening process, and a universal applicability. The unique locking mechanism includes a sliding latch on the underside of the cap that will allow a pill bottle to be inserted and the cap to lock around the pill bottle until an authorized user follows a prompt to unlock the cap from the bottle. The biometric scanner opens either the sliding mechanism to allow the pill bottle to be removed or opens the lid to allow access to the contents of the bottle. This depends on a button on the underside of the pill bottle cap. The pill bottle has a microprocessor that drives the functionality of the cap.

21 Claims, 15 Drawing Sheets

(56) References Cited

U.S. PATENT DOCUMENTS

| | | | | |
|---|---|---|---|---|
| 5,284,262 | A | 2/1994 | O'Nam | |
| 5,490,610 | A | 2/1996 | Pearson | |
| 5,571,258 | A | 11/1996 | Pearson | |
| 5,791,515 | A | 8/1998 | Khan | |
| 5,909,822 | A | 6/1999 | George | |
| 6,131,765 | A | 10/2000 | Barry | |
| 6,240,708 | B1 * | 6/2001 | Kassouni | B65D 51/18 53/420 |
| 6,382,416 | B1 | 5/2002 | Gainey | |
| 6,789,497 | B1 | 9/2004 | Aiken | |
| 6,912,878 | B2 | 7/2005 | Beldin, Jr. | |
| 7,007,523 | B2 | 3/2006 | Belden, Jr. | |
| 7,108,153 | B2 | 9/2006 | Wood | |
| 7,178,688 | B2 | 2/2007 | Naufel | |
| 7,337,899 | B2 | 3/2008 | Sterns | |
| 7,359,765 | B2 | 4/2008 | Varvarelis | |
| 7,553,235 | B2 | 6/2009 | Walker | |
| 7,568,586 | B2 | 8/2009 | Walters, Jr. | |
| 7,600,648 | B2 | 10/2009 | Hamer | |
| 7,605,704 | B2 | 10/2009 | Munro | |
| 7,654,261 | B1 | 2/2010 | Rockhold | |
| 7,735,684 | B2 | 6/2010 | Coe | |
| 7,765,776 | B1 | 8/2010 | Leu | |
| 7,866,497 | B2 | 1/2011 | Belden, Jr. | |
| 7,885,725 | B2 | 2/2011 | Dunn | |
| 7,917,246 | B2 | 3/2011 | Handfield | |
| 8,169,327 | B2 | 5/2012 | Lynn | |
| 8,228,197 | B2 * | 7/2012 | Murray | B65D 3/00 340/572.1 |
| 8,235,233 | B2 | 8/2012 | Pehr | |
| 8,237,541 | B2 | 8/2012 | Wang | |
| 8,249,295 | B2 | 8/2012 | Johnson | |
| 8,457,783 | B2 | 6/2013 | Hyde | |
| 8,502,692 | B2 | 8/2013 | Johnson | |
| 8,521,326 | B1 | 8/2013 | Holtje | |
| 8,538,775 | B2 | 9/2013 | Skomra | |
| 8,616,393 | B2 | 12/2013 | Vessa | |
| 8,636,172 | B2 | 1/2014 | Dunn | |
| 8,733,641 | B1 | 5/2014 | Drew | |
| 8,788,380 | B2 | 7/2014 | Hyde | |
| 8,805,702 | B1 | 8/2014 | Daniel | |
| 8,854,225 | B2 | 10/2014 | Johnson | |
| 8,862,266 | B2 | 10/2014 | Van Ooyen | |
| 8,931,652 | B2 | 1/2015 | Simpson | |
| 8,939,301 | B1 | 1/2015 | Small | |
| 8,939,365 | B1 | 1/2015 | Reese | |
| 8,948,914 | B2 | 2/2015 | Zini | |
| 8,970,380 | B2 | 3/2015 | Buco | |
| 9,031,690 | B2 | 5/2015 | Cotner | |
| 9,037,291 | B2 | 5/2015 | Terzini | |
| 9,061,879 | B2 | 6/2015 | Patthey | |
| 9,171,415 | B2 | 10/2015 | Adams | |
| 9,189,601 | B2 | 11/2015 | Simmons | |
| 9,278,789 | B2 | 3/2016 | Simpson | |
| 9,280,863 | B2 | 3/2016 | Spignesi, Jr. | |
| 9,299,210 | B2 | 3/2016 | Parrish | |
| 9,361,431 | B2 | 6/2016 | Fauci | |
| 9,367,061 | B2 | 6/2016 | Miller | |
| 9,373,239 | B2 | 6/2016 | Ebe | |
| 9,390,457 | B2 | 7/2016 | Baym | |
| 9,439,835 | B2 | 9/2016 | Dimartino | |
| 9,465,918 | B1 | 10/2016 | Lohman | |
| 9,465,919 | B2 | 10/2016 | Kamen | |
| 9,471,750 | B2 | 10/2016 | Garda | |
| 9,475,683 | B2 | 10/2016 | Givens | |
| 9,477,815 | B2 | 10/2016 | Butler | |
| 9,483,621 | B2 | 11/2016 | Conley | |
| 9,507,916 | B2 | 11/2016 | Charania | |
| 9,511,945 | B2 | 12/2016 | Greyshock | |
| 9,572,748 | B2 | 2/2017 | Lim | |
| 9,579,264 | B1 | 2/2017 | Litton | |
| 9,597,261 | B2 | 3/2017 | Baarman | |
| 9,623,225 | B2 | 4/2017 | Zhou | |
| 9,636,273 | B1 | 5/2017 | Harris | |
| 9,636,279 | B2 | 5/2017 | Song | |
| 9,638,461 | B2 | 5/2017 | Wait | |
| 9,643,320 | B2 | 5/2017 | Davey | |
| 9,662,392 | B2 | 5/2017 | Altschul | |
| 9,665,689 | B2 | 5/2017 | O'Brien | |
| 9,692,829 | B2 | 6/2017 | Starr | |
| 9,700,247 | B2 | 7/2017 | Dixon | |
| 9,710,608 | B2 | 7/2017 | Mikhail | |
| 9,728,070 | B2 | 8/2017 | Wegelin | |
| 9,730,860 | B2 | 8/2017 | Hamilton | |
| 9,760,691 | B2 | 9/2017 | Seeger | |
| 9,830,674 | B2 * | 11/2017 | Chung | G06Q 50/265 |
| 9,870,450 | B2 | 1/2018 | Blackburn | |
| 9,911,261 | B2 | 3/2018 | Gordon | |
| 9,913,778 | B2 | 3/2018 | Dvorak | |
| 10,124,940 | B2 | 11/2018 | Blackburn | |
| 10,216,907 | B2 | 2/2019 | Cameron | |
| 10,315,851 | B2 * | 6/2019 | Greyshock | B65G 35/00 |
| 10,350,143 | B2 | 7/2019 | Govindasamy | |
| 10,545,048 | B2 | 1/2020 | Pilkington | |
| 2007/0095851 | A1 | 5/2007 | Anderson | |
| 2007/0260491 | A1 | 11/2007 | Palmer | |
| 2008/0121000 | A1 | 5/2008 | Vessa | |
| 2008/0283542 | A1 | 11/2008 | Lanka | |
| 2009/0223994 | A1 | 9/2009 | Getz | |
| 2009/0281656 | A1 | 11/2009 | Draper | |
| 2010/0101317 | A1 | 4/2010 | Ashrafzadeh | |
| 2010/0185456 | A1 | 7/2010 | Kansal | |
| 2010/0270257 | A1 | 10/2010 | Wachman | |
| 2011/0139741 | A1 | 6/2011 | Gartner | |
| 2011/0163843 | A1 | 7/2011 | Vallone | |
| 2011/0259910 | A1 | 10/2011 | Knudsen | |
| 2012/0145740 | A1 | 6/2012 | Chu | |
| 2013/0304255 | A1 | 11/2013 | Ratnakar | |
| 2014/0324216 | A1 | 10/2014 | Beg | |
| 2015/0148943 | A1 | 5/2015 | Sullivan | |
| 2017/0020785 | A1 | 1/2017 | McCullough | |
| 2017/0049662 | A1 | 2/2017 | Fisher | |
| 2017/0079886 | A1 | 3/2017 | Sagynaliev | |
| 2017/0083687 | A1 | 3/2017 | Josyula | |
| 2017/0281467 | A1 * | 10/2017 | Solotoff | A61J 1/1412 |
| 2020/0130900 | A1 * | 4/2020 | Herbert | B65D 47/20 |

FOREIGN PATENT DOCUMENTS

| | | |
|---|---|---|
| EP | 1223855 | 10/1999 |
| EP | 1392944 | 6/2001 |
| EP | 2744096 | 7/2011 |
| JP | 4733918 | 10/2003 |
| JP | 2007526855 | 9/2007 |
| JP | 5894680 | 12/2011 |
| RU | 2494465 | 10/2007 |
| WO | WO/2007/008720 | 1/2007 |
| WO | WO/2007/016249 | 2/2007 |
| WO | WO/2010/054205 | 5/2010 |
| WO | WO/2011/079352 | 7/2011 |
| WO | WO/2012/102759 | 8/2012 |
| WO | WO/2013/127564 | 9/2013 |
| WO | WO/2016/059428 | 4/2016 |
| WO | WO/2016/064786 | 4/2016 |
| WO | WO/2016118082 | 7/2016 |
| WO | WO/2016/164187 | 10/2016 |
| WO | WO/2016/172516 | 10/2016 |
| WO | WO/2016/196977 | 12/2016 |
| WO | WO/2016/205609 | 12/2016 |
| WO | WO/2017/003953 | 1/2017 |
| WO | WO/2017/023204 | 2/2017 |
| WO | WO/2017/062986 | 4/2017 |

OTHER PUBLICATIONS

Pill bottle to help opioid overdose WSET, Oct. 20, 2017.

Safer Lock—Medicine Safekeeping for Good Health https saferlockrx.com Oct. 2, 2017.

(56) References Cited

OTHER PUBLICATIONS

The Smart Pillbox with Brains & Beauty; https elliegrid.com May 4, 2017.
Timer Cap https timercap.com Sep. 29, 2017.

* cited by examiner

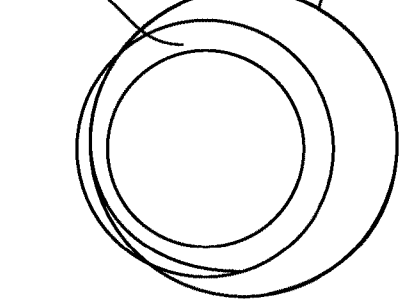
FIG.6A
FIG.6B
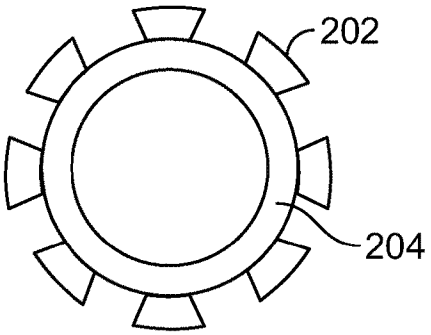
FIG. 6C
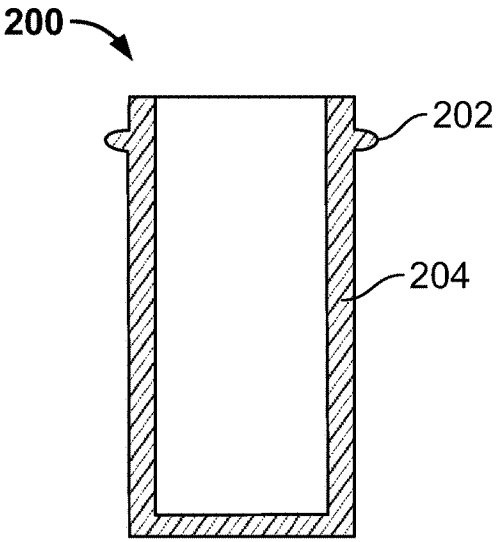
FIG. 7A
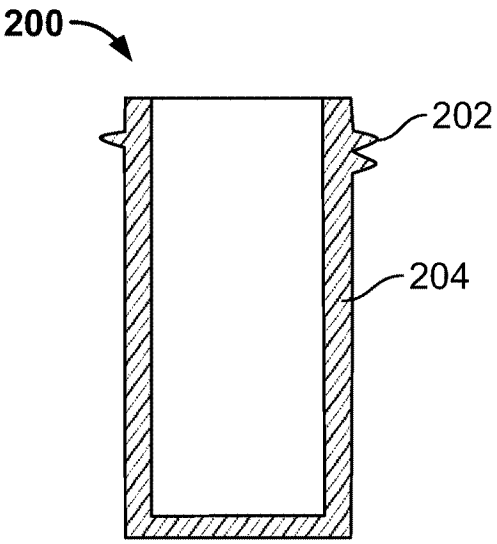
FIG. 7B
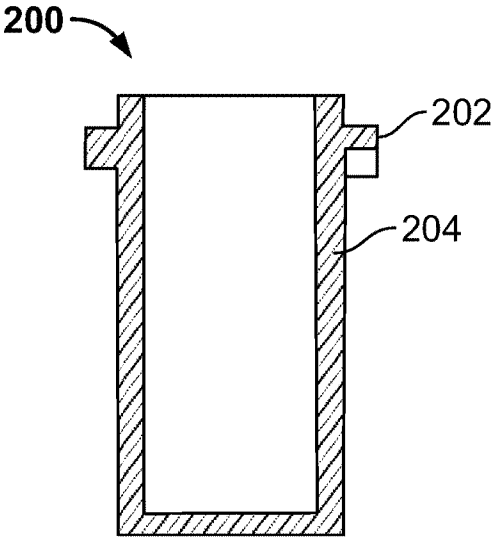
FIG. 7C

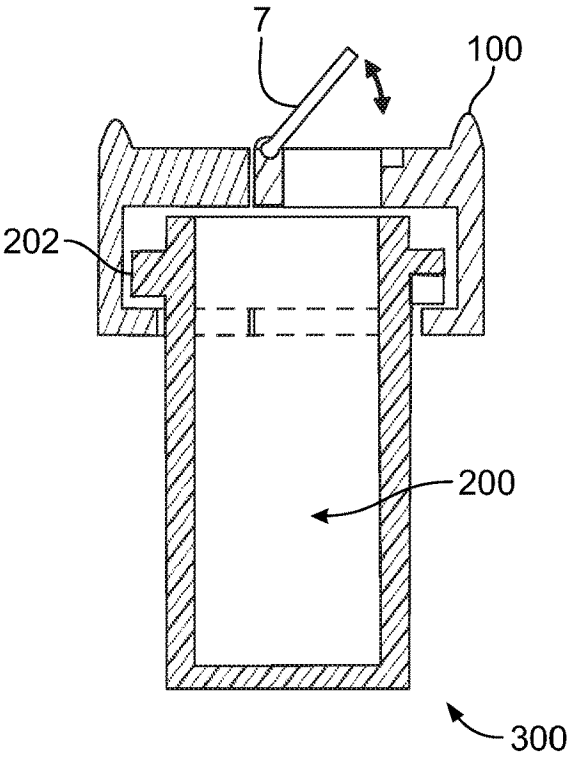
FIG. 14C
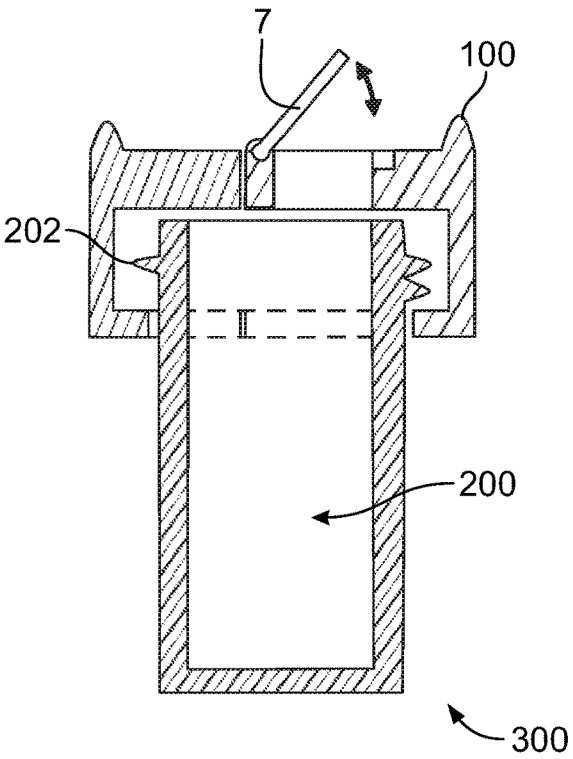
FIG. 14B
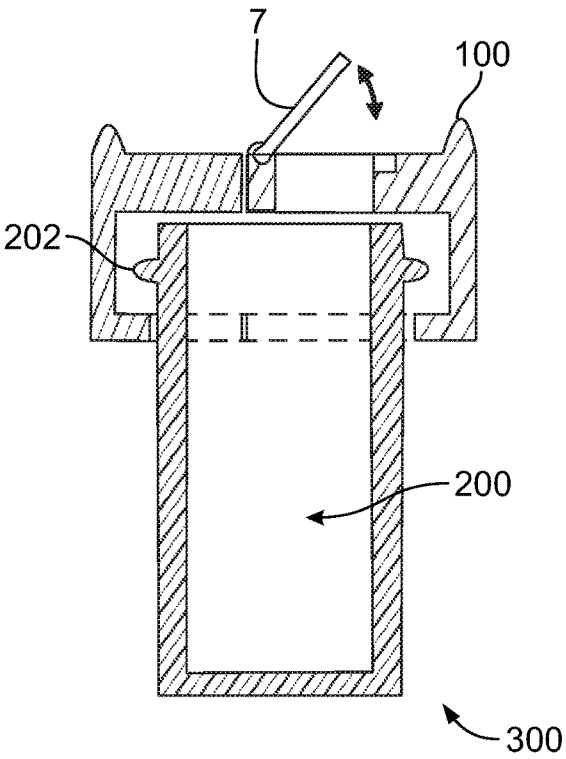
FIG. 14A
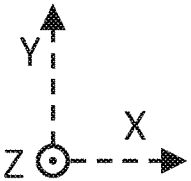

PERSONALIZED LID FOR PRESCRIPTION BOTTLES

CROSS-REFERENCE TO RELATED APPLICATION

The present application is a U.S. nonprovisional patent application of, and claims priority to, U.S. provisional patent application Ser. No. 62/590,052 filed Nov. 22, 2017, entitled "Personalized Lid For Prescription Bottles." This identified provisional patent application is hereby incorporated herein in its entirety by reference.

TECHNICAL FIELD

This disclosure generally relates to the field of containers, caps and lids for containers, and managing access to the contents of containers. More particularly, this disclosure relates to caps, lids, and containers, including those for pills.

BACKGROUND OF THE INVENTION

Over the past several decades and over the last several years in particular, the incidence of prescription drug abuse has increased at an alarming rate. It has become a regular occurrence for young people to steal prescription medications such as pain relievers, stimulants, and sedatives from family members and to subsequently distribute and abuse such medications for pecuniary gain, recreational use, and for perceived benefits such as weight loss or improved brain function. It is commonly believed by those who engage in such activities that prescription medications are safer than illicit drugs because they are regulated by the government and are dispensed by pharmacies. In reality, prescription medications can be, and often are, addictive, physically harmful, and even deadly when abused by individuals who come into possession of such medications without an appropriate prescription.

A cap for a bottle that includes a safety feature intended to prevent access to contents that could be harmful to young children has been known in the art for a substantial period of time. For example, U.S. Pat. No. 1,089,887, issued in 1914 to August A. Wave, discloses a particular bottle and cap "specially designed for use as a container for poisons," which has threading that, requires "reversed motions" for its removal. U.S. Pat. No. 2,061,214 to Sentman discloses a safety screw cap that may be threaded upon a bottle having conventional threads, and which may be simply removed with downward pressure in opposition to a spring, and with it thereafter being rotated without the use of any tools. U.S. Pat. No. 3,426,932 to Rouse discloses a "Tamper-Proof Poison Bottle Closure" that may be used on the threads of a bottle, with its removal requiring that the authorized person insert and turn the corresponding key in the keyhole. U.S. Pat. No. 3,313,441 was issued in 1967 to Jerome Fadden, and discloses a "Safety Combination Cap" intended for pill bottles, and requires that its plurality of disks be brought into alignment in order to remove the cap to extract the contents of the bottle.

One factor that has contributed to the rise of prescription drug abuse is ease of accessibility. Surreptitiously acquiring prescription medications typically requires no more effort than locating a pill bottle in the medicine cabinet of a friend or a family member. If there is a significant quantity of medication left in a particular bottle, it can be very easy for a perpetrator to remove several pills from the bottle without arousing the suspicion of the owner, who will generally not notice the missing quantity. It would therefore be advantageous to have a means for effectively deterring the theft of prescription medications. It would further be advantageous to have a means for making the theft of prescription medications evident to the owners of such medications. It would be advantageous to have security features for bottle caps and for other types of lids and containers regardless of their intended use. It would advantageous to have features of containers to notice or alarm of any deviation from proper use.

SUMMARY OF THE INVENTION

To provide an improved way of safely storing medication in an effort to reduce the abuse of prescription medications, what is needed is a new cap for common prescription bottles with upgraded features. The cap once locked onto the prescription bottle cannot be removed without user verification. The cap identifies each user with a biometric signature and opens conveniently with one step for easy access. The cap is universal, accommodating all original-sized pill bottles. These three unique features: the locking mechanism, the biometric signature, and the universal applicability make the unique pill bottle cap easily implemented and reduce the abuse of prescription medications.

The new pill bottle cap was created out of a need to better protect the prescriptions that all too often lead to drug abuse and drug addiction. The millennial generation has shifted its focus from stealing a few drinks from the liquor cabinet to stealing a few leftover pills from the medicine cabinet. The cap has unique features compared to the traditional child safe prescription bottles commonly found holding any prescription. The cap locks onto the pill bottle and cannot be removed without the authorized user following unlock prompts. In one embodiment, the cap will open to the medication after a biometric metric such as a biometric signature unlocks a top hatch of the cap. Common plastic pill bottles have a two-step push and turn unlocking mechanism making the traditional pill bottle child safe. However, based on empirical evidence this safeguard no longer protects medication from misuse and abuse within the household. The new cap maintains the child safety requirements with many added layers of security while reducing the process of dispensing medication from a two-step to a one-step process. Once the biometric signature is accepted the bottle will automatically open. One goal of the cap is to help a household stop a child from abusing prescription medication at the initial starting point, before it leads to drug abuse, as all too often happens after a first misstep.

With the rising opioid epidemic in the United States and Canada, governments, pharmaceutical companies, and families all are looking for a solution to prevent innocent people from falling victim to drug abuse and addiction because of one misjudgment. The power and grasp prescription medications have on the youth of our nation is overbearing and a single pill can change the course of a common teen's life forever. If the new cap is used with all commonly abused prescriptions, this will have a lasting effect on the rate of abuse of prescription medications so that a single child does not become addicted to these prescription medications.

The benefits of the new cap compared with a traditional pill bottle are numerous. To prevent possible misuse or abuse of medication within the household, the traditional pill cap is replaced. Furthermore, the new cap has a unique look that stands apart from other pill bottles. In one embodiment, the cap has a data collection aspect that is able to relay information to the prescribing doctor or physician in an effort to better prescribe medication based on the patient's ability to adhere to dosing and time requirements. Also, the cap can have a short message service (SMS) capability alerting the user by text when it is time to take a dose.

The new pill bottle has multiple functionalities that both reduce the difficulty of use of a typical pill bottle and improve upon security and modernization. The biometric locking pill bottle cap ("cap") has several unique changes from its typical predecessor. The cap may lock onto a ridge, lug, threaded portion, or other protrusion of a plastic bottle and will not detach until an authorized user prompts the biometric system to unlock, for example, by providing a suitable biometric signature. One goal of the permanently locking system is to mitigate the abuse of prescription medication in the household by getting rid of the easy accessibility that comes with a typical two-step plastic pill bottle. The cap will show tell-tale signs when someone has tampered with the pill bottle because in order to remove the locked-on cap the plastic bottle will be distorted. Furthermore, it is important to note that the cap houses the permanent locking system. The top of the cap may feature a biometric scanner, one or more buttons, and a unique popping spring system to open the hatch or lid for access to the contents of the bottle. The biometric system is able to store well over a thousand fingerprints. This is important to note because everyone who needs access to the prescription can use his or her own biometric signature as an identification method and as a barrier between other persons and the pills. Once the scanner permits an authorized user entry into the housing of the pills, the lid opens. In one embodiment, the lid may pop open by a microprocessor reading a fingerprint (or other biometric signature) and then releasing a pin that protrudes from one side of the lid and fits into the outer housing of the cap when locked. When the scanner registers a fingerprint, a spring opposite the side with the pin exerts a force to open the lid. Thus, when the pin releases, the lid effectively pops open.

The universal lockable bottle cap is capable of engaging to any bottles or containers having multiple radius and different locking thread orientations. In one embodiment, the cap housing consists of two parts namely first and second part. Wherein the first part consists of a first top portion, a first skirt portion extending from the first top portion along the axis of the cap. Further a first lip portion extending radially inward from the first skirt portion is provided to hold the circumference of the bottle opening and it is formed to have concave shape.

The second portion of the cap also consists of a second top portion, a second skirt portion extending from the second top portion along the axis of the cap. Further a second lip portion extending radially inward from the second skirt portion provided to hold the circumference of the bottle opening and it is formed to have concave shape.

The third part of the cap is an integral part of at least one of the first and second part that extends laterally between the first part and second part to permit the relative lateral translation of the first and second parts between the retracted and extended position. Wherein the retracted position the first and second parts are proximal to each other and during the extended position the first and second parts are spaced apart from one another compared to the retracted position. Further, a first locking means is provided to lock the first and second parts.

In one embodiment, at least one of the first and second part of the cap comprises extensions or apertures on both parts which couple and lock together (to each other). The two or more parts of the cap lock together to form a fit around an object such as a bottle or container. During opening or retraction, the extensions and the apertures move in axial direction and decouple from each other. In one embodiment, this decoupling is done by unlocking the connection by means of microcontroller. Further, the extensions can be formed in different shapes such as cylindrical, rectangular or any preferred shape.

The new pill bottle cap embodiment has multiple functionalities designed to provide easy access to medication for persons who struggle with the push and twist motion that is required by many current bottle cap designs, as well as improving on security and modernization. The personalized bottle cap differs from current pill bottle cap designs by means of several distinct features.

The cap possesses a biometric security control system. In one embodiment, the biometric security system is in the form of a fingerprint scanner on the top portion of the cap. The scanner is responsible for both the locking or accessing and unlocking of the bottle cap from the pill bottle, and the opening of the lid which forms a passage for drug accessing. The lid may take various shapes including a semicircular or semi-oval shape. In one embodiment, the lid is situated on the top portion of the personalized bottle cap, which allows the user to access their medication. The types of medications anticipated to be secured might not need to be accessed by multiple people, however if there is a long list of people who need access including doctors and pharmacists, this will not prove to be a problem. Furthermore, the personalized bottle cap is interchangeable, so a new fingerprint is not required every time the bottle cap is transferred from one pill bottle to another. In some embodiments, a small button is located on the personalized bottle cap. The small button determines whether or not the fingerprint being read is to unlock the cap from the pill bottle or to open the lid on top of the cap. The same fingerprint may be used for both circumstances, and the fingerprint may be required to access any medication. The button is used to signal to the microcontroller, which also recognizes the correct fingerprint, what part of the cap is to be opened: the lid or the entire cap.

The personalized bottle cap closes around the pill bottle rather than possessing the twist-on design present on current bottle caps. There are two main body sections to the personalized bottle cap, one of which slides outwards on a two-rail system. A lower section of the bottle cap extends outward laterally to allow for the insertion of the pill bottle from underneath. Once the pill bottle is in position underneath the cap, the extended section slides back into place to close around the pill bottle. A protrusion, for example, a lip, thread, ridge, flange, or lug finish, extends around the circumference of the pill bottle. The concave section within the cap can accept the protrusion allowing the cap to sit flush around the bottle. Once the cap is placed around the bottle protrusion, a pin then falls into the rail system, impeding movement along the rail so the cap cannot be reopened without the correct fingerprint. Once the correct fingerprint is recognized, the pin is lifted from the rail system thereby opening up movement along the rail system allowing the cap to be opened. By designing the personalized bottle cap to close around the pill bottle, individuals that have lost dexterity or find the push-turn design on existing bottle caps difficult will now be able to access their medication by means of a fingerprint.

The electronics and other structures within the cap may be distributed in a way that balances the system when the cap is attached to the pill bottle. In one embodiment, the personalized bottle cap is designed to rest upside-down on four small feet, which may be rectangular prisms that are located at each corner on top of the bottle cap. This gives the cap four solid contact points to rest on as well as protecting the fingerprint scanner or other bio scanner from damage.

One unique feature is the way that the cap has a sliding locking portion so that the pill bottle can be inserted into the cap and the ridges of the pill bottle sit flush in a cavity within the cap that disallow movement once the sliding section slides back into its original place. This locking mechanism locks the contents of the pill bottle so that it cannot be accessed without an authorized user scanning their fingerprint on the biometric scanner.

The biometric scanner serves two purposes for the cap. First, the recognition of a fingerprint may unlock the lid to permit access to the medication through the cap. Second, the recognition of a fingerprint may unlock the main locking mechanism that keeps the sliding locking portion in the closed position. In some embodiments, the system differentiates between the two different functions of the scanner depending upon three clicks of a button located on the trapezoidal prism located on the opposite outer corner under the cap.

In one embodiment, the microprocessor/microcontroller is programmed (e.g., by software or firmware stored in a memory or storage device) so that any time the button is pressed three times in rapid succession, during the next interval, which may be seven seconds, if an authorized fingerprint is correctly scanned then the pill bottle will release the sliding locking mechanism so that the cap can release the pill bottle. If no authorized fingerprint is scanned in the seven seconds then the biometric scanner will revert back to the mode of operation for opening the pill bottle lid.

When a user presses and holds the button for five seconds then the scanner and microprocessor/microcontroller will retain the next fingerprint scanned as a new fingerprint that can unlock the cap. In one embodiment the system is able to store up to 20 fingerprints. In other embodiments many more fingerprints are stored.

A unique feature of the cap is that it reduces the steps to opening a child-safe pill bottle from two steps to one step. When the biometric scanner scans a correct fingerprint then the lid allows the user access to the pills by automatically opening, thus making the cap a one-step system. By contrast, many traditional pill bottles deploy some version of the pushdown and turn locking mechanism.

The new pill bottle cap is universal due to its unique sliding locking mechanism design allowing it to pair with all regular sized pill bottles. The universal application differentiates the cap from a specific pharmacy or prescription because it can be reused for different prescriptions as well as taken to different pharmacies unlike anything on the market.

In another embodiment, a process is used to open a container having a cap or lid, the process comprising: pressing a finger to a fingerprint sensor; determining a first fingerprint information from the finger by the fingerprint sensor; providing the first fingerprint information to a microcontroller; comparing the first fingerprint information to a stored fingerprint information by the microcontroller; and unlocking a lock by use of a microcontroller and motor when the first fingerprint information matches the stored fingerprint information.

In another embodiment, the microprocessor/microcontroller records the time and place a user takes the contents of the pill bottle. This data allows for accurate measurements of the dosage schedule compared to the prescribed dosage schedule for review by the user and doctor or prescribing physician.

In another embodiment, a system for detecting deviation from a prescribed dosing regimen is described comprising: a biometric sensor for opening the lid for drug access; a microprocessor connected to at least one of a clock or a counter which records the amount of drug accessed and/or the time, wherein the microcontroller correlates the amount of drug accessed out with prescribed dosage regimen to calculate the deviation; and an indicator is used to alert the user regarding the deviation from the dosage regimen. Further, wherein the amount of drug accessed from the bottle can be identified based on the weight, size or volume change from before and after the bottle was accessed.

While the examples depicted are primarily directed to a pill bottle, the inventions described may be used with many other types of containers and is not limited to any particular bottle or type of use.

BRIEF DESCRIPTION OF THE DRAWINGS

Various aspects of the claimed invention are next discussed with respect to non-limiting embodiments shown in the attached figures, wherein:

FIG. 6A is a top view of a bottle having a protruding ridge according to an embodiment;

FIG. 6B is a top view of a bottle having a protruding thread according to an embodiment;

FIG. 6C is a top view of a bottle having a protruding lugs according to an embodiment;

FIG. 7A is a cross-sectional side view of a bottle having a protruding ridge according to an embodiment;

FIG. 7B is a cross-sectional side view of a bottle having a protruding thread according to an embodiment;

FIG. 7C is a cross-sectional side view of a bottle having a protruding lugs according to an embodiment;

FIG. 14A is a cross-sectional side view diagram illustrating an embodiment having a lid in an intermediate position and having a sliding locking mechanism in a closed position on a radial ridge protrusion of a container;

FIG. 14B is a cross-sectional side view diagram illustrating an embodiment having a lid in an intermediate position and having a sliding locking mechanism in a closed position on a threaded protrusion of a container;

FIG. 14C is a cross-sectional side view diagram illustrating an embodiment having a lid in an intermediate position and having a sliding locking mechanism in a closed position on a lugged protrusion of a container;

DETAILED DESCRIPTION

Figure 1:
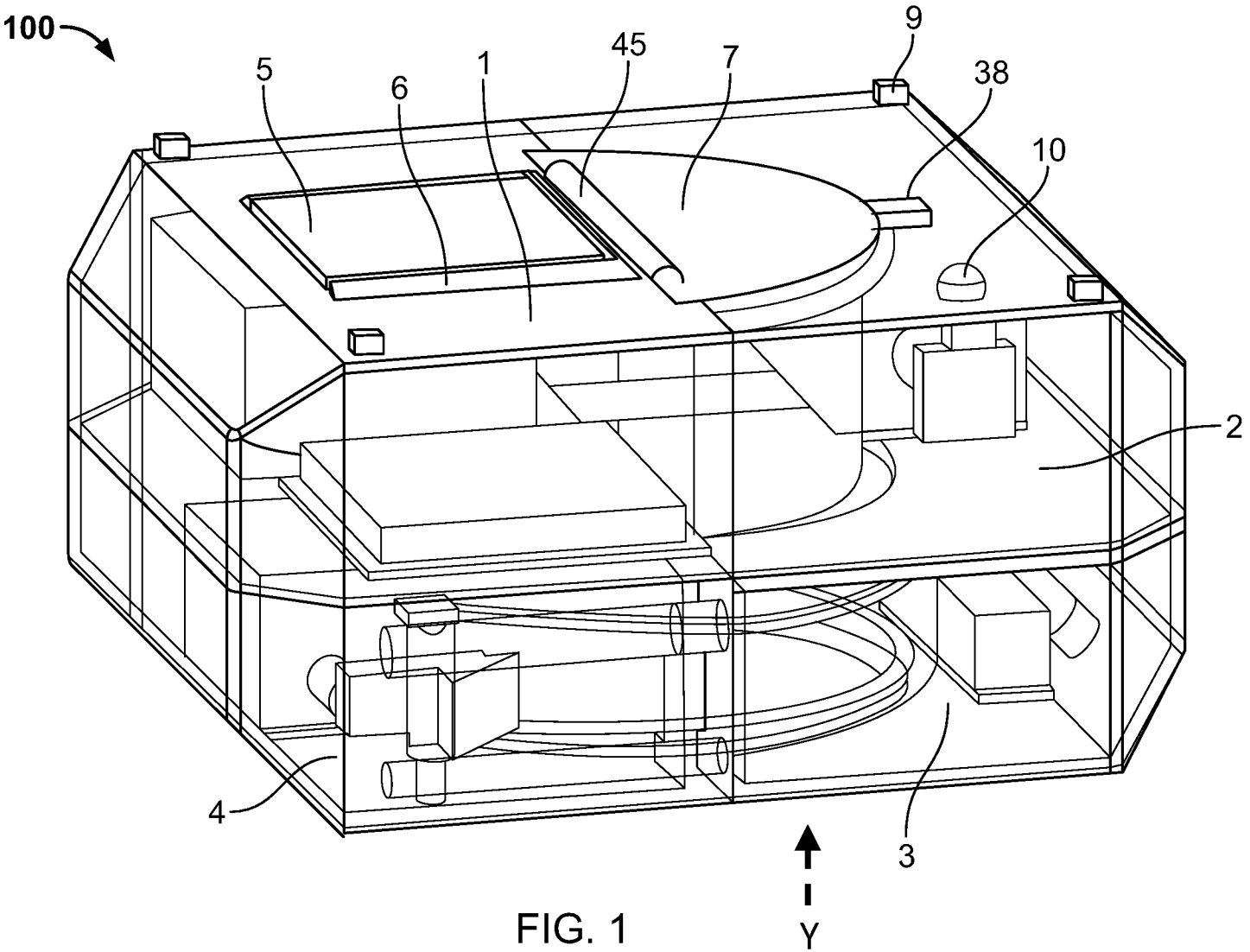
FIG. 1 is a perspective view of a cap embodiment in a closed position.

Prior to proceeding to the more detailed description of the present general inventive concept it should be noted that, for the sake of clarity and understanding, identical components which have identical functions have been identified with identical reference numerals throughout the several views illustrated in the drawings.

FIG. 1 depicts an exemplary cap 100 in a fully closed position. In FIG. 1, the cap 100 includes an outer housing 101 (shown as transparent in the figures to enable interior viewing) divided into four quartiles 1, 2, 3, 4. Each quartile is hollow with a wall thickness of, for example, 0.03 cm, 0.05 cm, or 0.1 cm. In some embodiments, the quartile walls may be thinner or thicker. In other embodiments, one or more of the quartiles may have a different thickness from another of the quartiles. In still other embodiments, one or more of the quartiles may have walls of non-uniform thickness. The division of the outer housing 101 into the 4 quartiles is an example of an outer housing divided into four sub-sections, each of the quartiles being an example of a sub-section. In some embodiments, the outer housing 101 of the cap 100 is divided into a different number of sub-sections. In some embodiments, the outer housing 101 may have two sub-sections. In another embodiment, the outer housing 101 may have three sub-sections. In still other embodiments, the outer housing 101 may have five or more sub-sections.

In one embodiment of the invention the cap 100 can be formed of any material not limited to plastic, metal, glass, ceramic, etc. and variations thereof based on the requirements of the particular application.

The cap 100 possess a generally rectangular shape as shown in FIG. 1 but the invention is not limited to a particular shape and others may be used for example oval, circular, trapezoidal, square, etc.

The cap 100 possesses a biometric fingerprint scanner 5 and a spring-loaded lid 7 that may pop or bias open on a hinge 45 any time a user places a correct fingerprint upon the scanner 5.

The biometric fingerprint scanner 5 is an example of a biometric sensor. In some embodiments, other types of biometric sensors may be employed to ascertain a user's identity based upon one or more of the user's recorded personal attributes. Various embodiments may employ biometric sensors and systems operating by way of voice recognition, retinal imaging, facial recognition, or other means to identify a person based on one or more of the person's recorded personal attributes. Such biometric systems may store one or more samples of an authorized user's personal attribute, e.g., a fingerprint, a voice waveform, an eye scan image, a facial scan image, or the like. Biometric systems in various embodiments may verify a user's identity by comparing information received from a sensor to information regarding the one or more recorded personal attributes previously recorded by an identified user. Generally, these user attributes will be stored in a memory device for comparison.

Still referring to FIG. 1, the spring-loaded lid 7 is an example of a removable closure device. In some embodiments, other types of removable closure devices may be employed to cover and uncover an aperture that extends through the cap 100 along an axis Y passing through the top and the bottom of the cap 100. When a removable closure device—such as the spring-loaded lid 7 is open, this may permit a material such as a medicine in the form of one or more pills or liquid medication to pass through the cap 100 parallel to the Y-axis. When the removable closure device is closed, it may restrict movement of the material through the cap 100 parallel to the Y-axis. In some embodiments, the removable closure device may be gas-tight. For example, the removable closure device may form an air-tight seal with the outer housing 101 (shown as transparent) of the cap 100. In other embodiments, the removable closure device may be liquid-tight. For example, the removable closure device may form a water-tight seal with the outer housing 101 of the cap 100. In still other embodiments, the removable closure device may be selectively permeable to one or more substances. For example, the removable closure device may permit ambient air to penetrate the cap 100 while at the same time restricting pills from passing through the aperture.

In some embodiments, the removable closure device may be formed integrally with the cap 100. For example, the hinge 45 may be a living hinge. In other embodiments, the removable closure device may be separate from the cap 100. For example, the hinge 45 may be a barrel hinge and the lid 7 may be a rigid door.

The spring-loaded lid 7 is an example of a removable closure device that is movable between closed and open positions by swinging away from a top surface of the cap 100 on the hinge 45. The hinge 45 is an example of a peripheral hinge, being at a periphery of the lid 7. In other embodiments, other removable closure devices may be employed, including but not limited to a disk, a barrel, a plate, or a sheet. Such alternative embodiments may be moved between closed and open positions by one or more actions including but not limited to rotation in a plane parallel to a top surface of the lid, rolling, sliding extension and retraction, or coiling and uncoiling. For example, in some embodiments, rather than the spring-loaded lid 7, to cover and uncover an aperture in the lid, there may instead be a removable closure device formed by: a disk that rotates in a plane parallel to the top surface of the lid; a barrel that rolls about an axis perpendicular to the Y axis; a plate that slidingly extends and retracts; or a flexible film or fabric that coils and uncoils. Each of these examples provide an opening for dispensing material from the container or bottle.

The biometric fingerprint scanner 5 is surrounded on three sides by a slanted guarding 6 to protect the fingerprint scanner 5. The slanted guarding 6 is an example of a protective structure. In some embodiments, other protective structures may be employed, including—but not limited to—a molding, a frame, or one or more protrusions extending in a direction normal to a surface of the fingerprint scanner 5 at one or more edges of the fingerprint scanner 5.

In some embodiments, a scanning surface of the biometric fingerprint scanner/reader 5 may be elevated from the outer housing 101 of the cap 100. In other embodiments, the scanning surface of the fingerprint scanner 5 or other biometric scanner 5 may be flush with the outer housing 101 of the cap 100. In still other embodiments, a scanning surface of the fingerprint scanner 5 may be recessed below an outer surface of the outer housing 101 of the cap 100.

The cap 100 includes four supports 9 one at every corner on the top of the cap 100 to protect fragile components located there from a fall. In some embodiments, there may be a different number of supports. For example, three supports, or five or more supports may be employed. The supports 9 may be formed integrally with the outer housing 101 of the cap 100, or they may be attached to the outer housing 101 of the cap 100. The supports 9 are shown as rectangular protrusions, but they are not so limited. In some embodiments, one or more supports may have other shapes. For example, the supports may be rounded. In other embodiments, a single support may be provided in the shape of a ring, a square, or another shape extending away from a surface of the outer housing 101. Advantageously, the cap 100 (and an attached container), when inverted, may be stabilized to resist tipping by balancing on one or more supports, such as the supports 9.

Still referring to FIG. 1, there is a small notification light 10 that is to notify the user when the cap 100 is ready to save fingerprints, when the entire cap 100 is ready to be opened, and when the power supply is low enough such that there is only enough power for a limited number of openings of the lid 7. The notification light 10 is an example of a notification device. In some embodiments, one or more notification devices may be employed in combination with, or in place of, the notification light 10. Some embodiments employ a haptic device, such as a vibratory motor, to provide tactile notification. Other embodiments employ an audio device, such as a speaker, to provide audible notification. Still other embodiments may employ other devices to provide other forms of notification.

Figure 2:
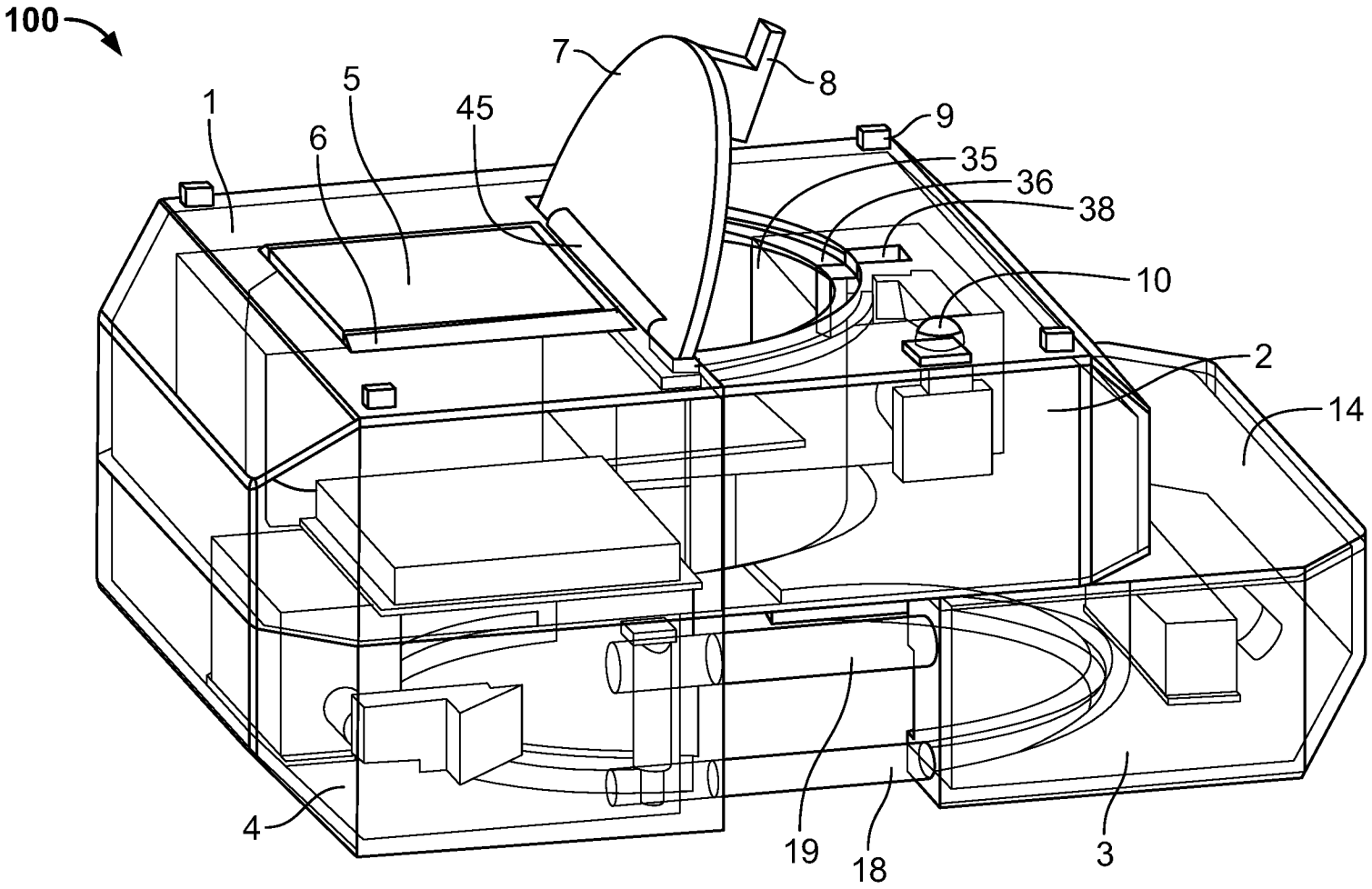
FIG. 2 is a perspective view of a cap embodiment in an open position.

FIG. 2 depicts the cap 100 in its fully open position. A small protrusion 8 located on the underside of the lid 7 locks into place when the lid 7 is closed. More particularly, the protrusion 8 falls into an opening 38 to be locked down. When the lid 7 is down, it sits flush within an area 36 such that the top of the lid 7 is in line with the top surface of quartile 1. When the entire cap 100 opens, quartile 3 slides out a distance of, for example, 0.75 cm, 1.5 cm or 2.0 cm along two solid cylinders 18, 19. This creates an opening that allows for a pill bottle to be inserted from underneath. The slide distance is primarily a factor of the size of the opening of the bottle or container.

In an embodiment of the cap, the quartiles 1, 2 & 4 can be combined to form a first part and further the quartile 3 can be formed as second part. In this manner, quartile 3 can move relative to the remaining quartiles.

The cylinders 18, 19 are an example of a translational interface between two parts of the cap 100. A first part (comprised of quartiles 1, 2, and 4) can be separated from a second part (quartile 3) by a translational movement along the cylinders 18, 19. In some embodiments, it is not necessary that the two cylinders 18, 19 be solid. For example, some embodiments may employ hollow cylinders. It likewise is not necessary that the two cylinders 18, 19 have circular cross-sections. Indeed, some embodiments may employ rails having square, rectangular, or other non-circular cross-sections. Other embodiments may employ splines, threads, teeth, or other features in the translational interface between the first and second parts of the cap 100.

Figure 3:
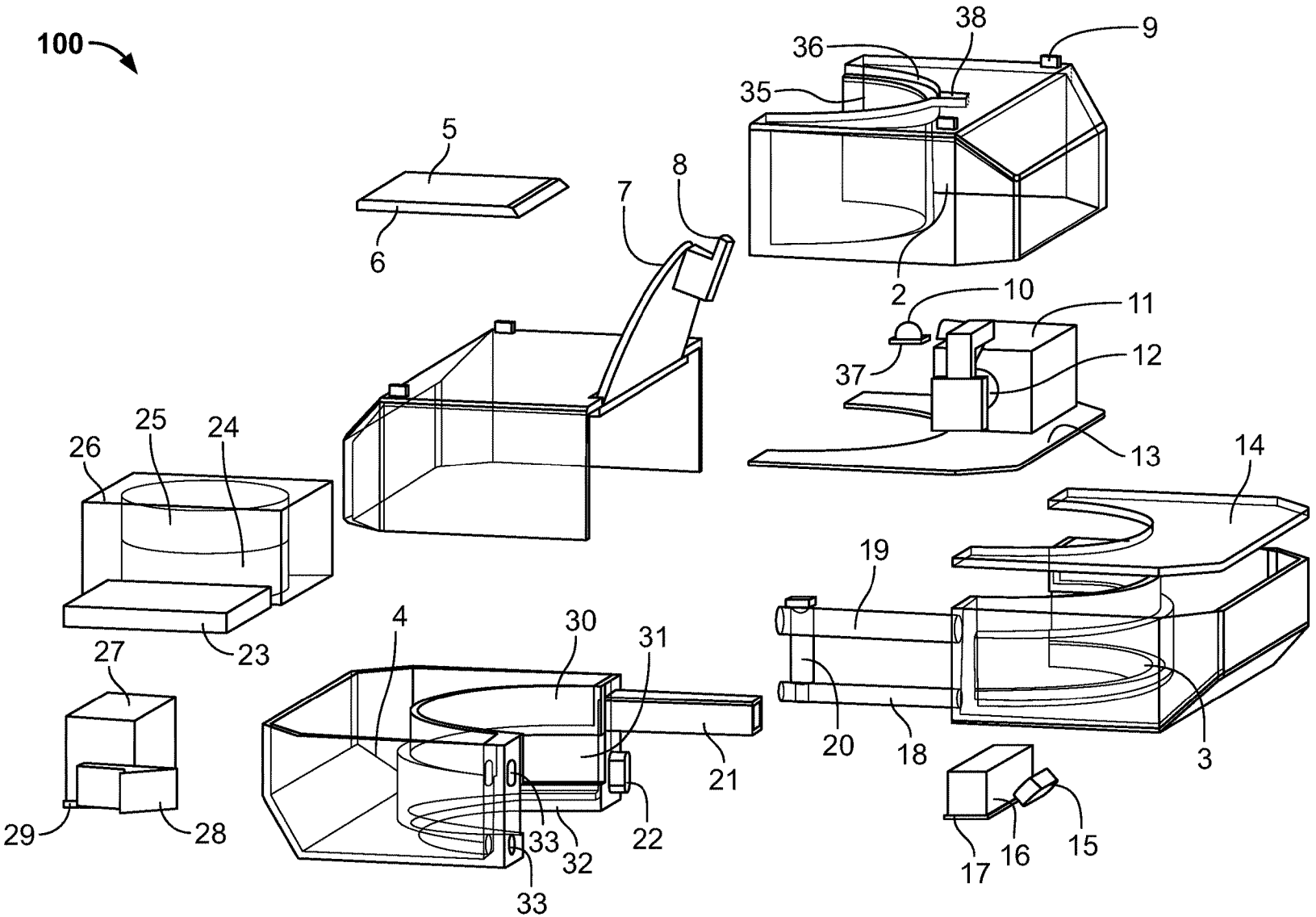
FIG. 3 is an exploded view of an embodiment of a cap.

FIG. 3 depicts a completely disassembled view of the exemplary cap 100. The two batteries 24, 25 are located in the battery unit 26 which is located within quartile 1. Next to the battery unit 26 is the area designated to house the motherboard 23 of the cap 100. A microcontroller/microprocessor and data storage unit are situated on the motherboard 23. Located within quartile 2 is the notification light 10 and the base plate 37 on which the light 10 rests, as well as a motor 11 used for the locking mechanism of the lid 7, as well as the base plate 13 of the motor 11. When the lid 7 locks, the lid's protrusion 8 comes down on part 12 until protrusion 8 is underneath an outstretched section of part 12. This happens because the bottom of the protrusion 8 is slanted and the top of the outstretched section of part 12 is slanted. Part 12 is connected to the rod of the motor 11 which is extended with the help of a spring. When the protrusion 8 comes down on the part 12, it will push the part 12 back to allow the protrusion 8 to fall until it is below the outstretched section of part 12. Located in quartile 3 is the button 15 and the area designated for the button electronics 16 and the base plate 17 for the button electronics 16. The button 15 is to be pressed when the user wishes to save a fingerprint or when the user wishes to open the entire cap 100, not the lid 7. Part 20 is a pin that prevents quartile 3 from sliding all the way out when the entire cap 100 is opened. Located in quartile 4 is the motor 27 for the locking mechanism responsible for opening the entire cap 100, the locking arm 28 connected to the motor 27, the base plate 29 for the motor 27, the hollow rail 21 which provides a passageway for electronics and/or electrical connections, the magnet 22 that helps keep the cap 100 closed together, and the openings 33, 34 in which the solid cylinders 18, 19 slide. The side where the openings 33, 34 are located may be thicker than the other sides of the cap 100 to provide reinforcement.

Area 35 represents a hollowed-out half cylinder that allows medicine to be dispensed. Area 35 is an example of an aperture that extends through the cap 100 along an axis Y. It may have a profile that is the same as an outer profile of a pill bottle. Similarly, areas 30 and 32 may have profiles that match portions of the profile of the pill bottle, and section 31 may be as wide as an outer protrusion on the pill bottle so that the pill bottle may sit within the cap 100 and not fall out. Area 30 is an example of a first top portion. Section 31 is an example of a first skirt portion that extends from the first top portion along the Y-axis. Area 32 is an example of a first lip portion that extends radially inward from the first skirt portion. Together area 30, section 31, and area 32 form a first concave section.

Figure 4:
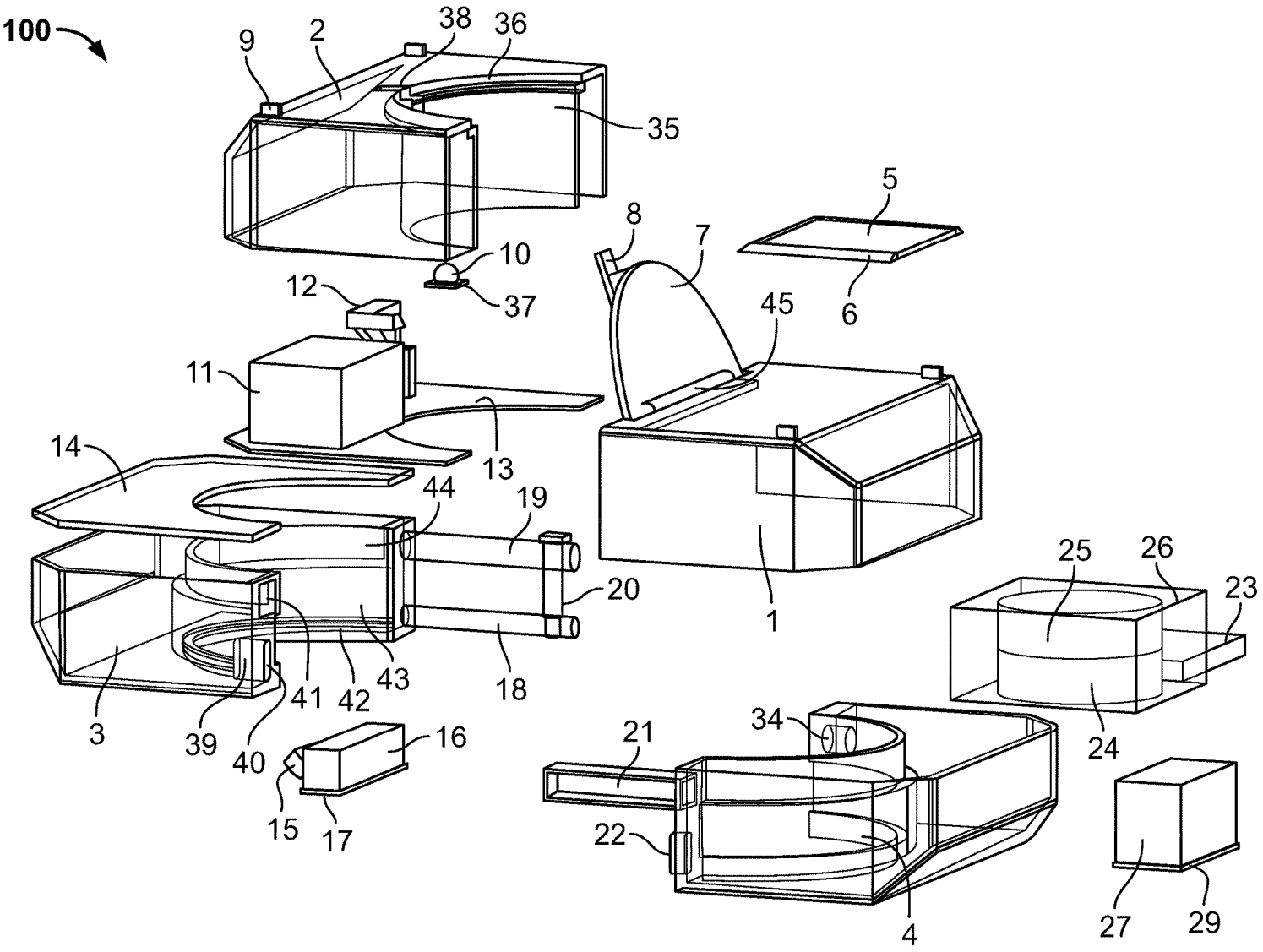
FIG. 4 is an exploded view of the embodiment of FIG. 3, viewed from a perspective 180 degrees opposite that of FIG. 3.

FIG. 4 is a 180° rotation about the Y-axis of the same disassembled view depicted in FIG. 3. In this example, quartile 3 houses the magnet 39 that attracts magnet 22 located on quartile 4. The hollow area 40 is where magnet 22 sits when the cap is closed. Areas 42 and 44 are the same or similar diameters as sections 30 and 32 in FIG. 3 and section 41 is just as much wider as section 31 in FIG. 3.

Area 44 is an example of a second top portion. Section 43 is an example of a second skirt portion that extends from the second top portion along the Y-axis. Area 42 is an example of a second lip portion that extends radially inward from the second skirt portion. Together area 44, section 43, and area 42 form a second concave section.

The opening 41 is where the hollow rail 21 will enter. Section 14 may be added on because the electronics located in quartile 3 may be installed before section 14 can be situated.

Figure 5C:
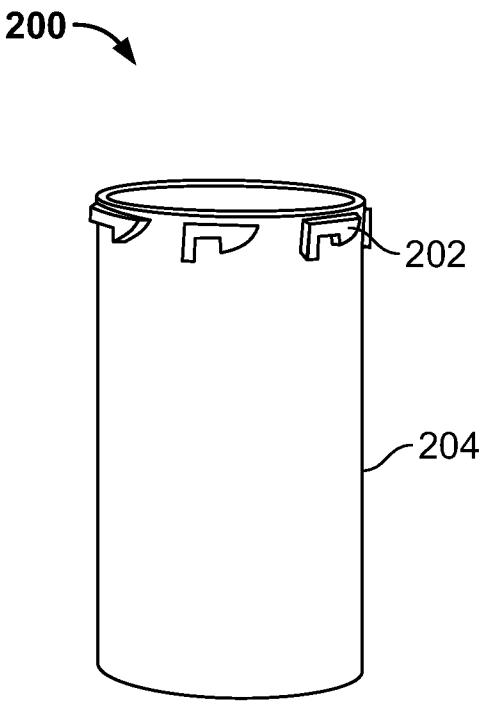
FIG. 5C is a side view of a bottle having a protruding lugs according to an embodiment.
Figure 5B:
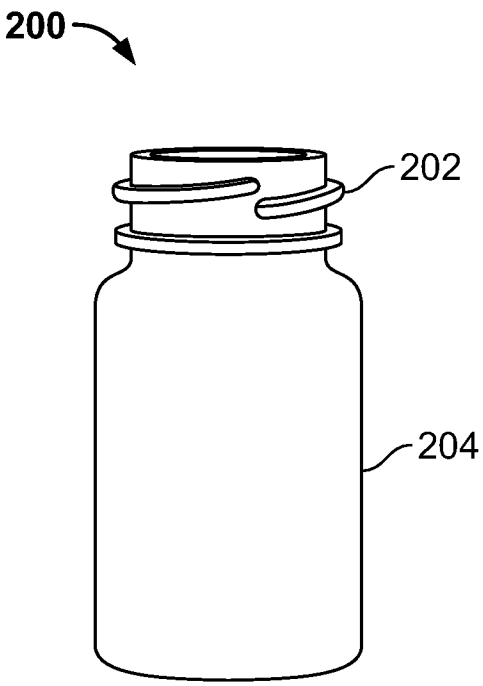
FIG. 5B is a side view of a bottle having a protruding thread according to an embodiment.
Figure 5A:
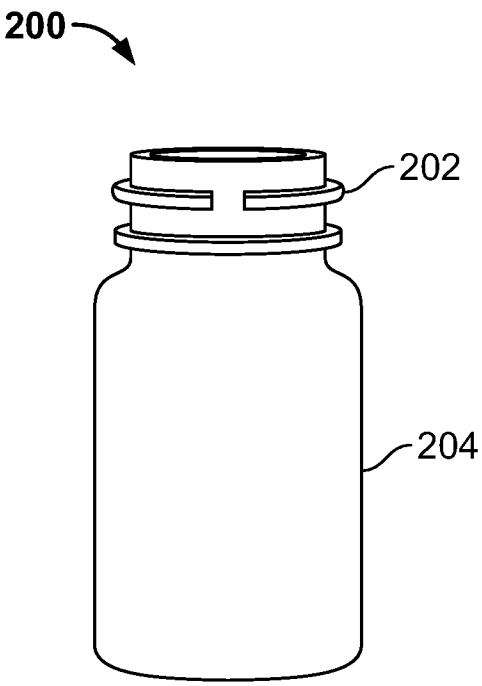
FIG. 5A is a side view of a bottle having a protruding ridge according to an embodiment.

FIGS. 5A, 5B and 5C depicts side views of exemplary bottles 200 used to store any content within, for example, pills, liquids, powders, creams, coins, foods, etc. The cap and bottle combination provides secure access and also can help to limit or prevent atmospheric exposure. The exemplary bottles are formed with a volume enclosed by one or more walls 204 have at least one opening in the axial direction. The exemplary bottles 200 have an opening or mouth through which the contents are placed or stored inside the space available within the bottle 200. Further, near the opening or mouth the bottles have protrusions 202 which are of different configurations and orientations shown separately in FIG. 5A-5C.

The protrusion 202 formed in the FIG. 5A to 5C can be of different configurations such as, for example, protruding ridge (FIG. 5A), thread (FIG. 5B), lugs (FIG. 5C) or combinations thereof. Further the bottle 200 can be form or supplied with protrusions 202 in the form of continuous thread; lip; lug; bayonet closure; rim; a flange; a snap fitting, etc. and combinations thereof.

According to other embodiment, the bottle 200 can be a vial; package; jar; ampoule; tube; bucket; bottle; box; carton or any other storage chamber.

The bottle 200 can be formed of different materials such as plastic, glass, steel, ceramic, copper and the like based on the requirement of an situation. The bottle 200 may also be formed of transparent material have different shape configurations.

The protrusion 202 can be formed either of same or different materials as the exemplary bottle 200.

The protrusion 202 can be of different shapes and lengths such as short, long or one step or multiple steps according to the user requirement.

In some embodiments, the bottle 200 can be closed or sealed to prevent access to other users and also prevent from atmospheric exposure by using a cap 100 using a gas-tight secure locking mechanism.

FIG. 6A a top view of the bottle 200 along with protrusion 202 is explained in view of FIG. 5A. Specifically, exemplary protrusion 202 are shown on the external surface of the bottle 100. Further the protrusion 202 are generally located near the ends of the bottle 200. FIG. 6A depicts a dual ring-shaped design shown from top view whereas the inner ring structure is nothing but the walls 204 of the bottle 202. Further, the outer ring-shaped structure denotes the protrusions 202. Specific the protrusion 202 shown in FIG. 6A is an example of a protruding ridge.

FIG. 6B a top view of the bottle 200 along with a protrusion 202 is similar to that shown in the view of FIG. 5B. Specifically, the protrusion 202 is shown on the external surface of the bottle 100. Further the protrusion 202 are generally located near the ends of the bottle 200. FIG. 6B shows a ring-shaped design with an overlapping circle shown from the top view where the inner ring structure is the walls 204 of the bottle 202. Further, the overlapping circle shaped structure denotes the protrusions 202. Specifically, the protrusion 202 shown in FIG. 6A depicts protruding thread. The protruding thread 202 can be either continuous or discontinuous having an angle.

FIG. 6C shows a top view of the bottle 200 along with protrusion 202 and is related to the view of FIG. 5C. Specifically, the protrusion 202 is shown on the external surface of the bottle 100. Further the protrusion 202 is generally located near the ends of the bottle 200. FIG. 6C depicts a ring-shaped design with circumferential or radial covered protrusions whereas the inner ring structure is the walls 204 of the bottle 202. Further, the circumferential covered protrusions 202 is an example of lugs. In specific the protrusion 202 shown in FIG. 6C, about the bottle use, shows circumferentially a pair of lugs used to lock the bottle 200 with the cap 100.

According to other embodiment of the invention the bottle 200 can be formed or assembled with protrusions 202 in the form of continuous thread; lip; lug; bayonet closure; rim; a flange; a snap fitting, etc. and variations thereof.

FIG. 7A to 7C depicts the cross-sectional view of a bottle 200 with a protrusion 202 corresponding to the views of FIG. 5A to 5C respectively. Wherein the bottle 200 has one or more walls 204 with an opening in the axial direction. Further the opening/mouth is required to place or store the contents within the bottle 200. Further the opening/mouth of the exemplary bottles have protrusions 202 which are of different configurations and orientations shown separately in FIG. 7A-7C.

The protrusion 202 formed in the exemplary bottles of FIG. 7A to 7C can be of different configurations such as protruding ridge (FIG. 7A), thread (FIG. 7B) or lugs (FIG. 7C). Further the bottle 200 can also be formed with protrusions 202 in the form of continuous thread; lip; lug; bayonet closure; rim; a flange; a snap fitting, etc. and variations thereof.

FIGS. 8 to 13 depicts a stage by stage process of using the bottle 200 with cap 100. The method shown includes accessing of the contents from the bottle 200 by opening the lid 7 to access that the contents in the container such as pills, powder, coins, etc. by the authorized individuals based on the respective biometric input. This system and method may be used to mitigate the abuse of prescription medication in the household.

In general, the exemplary universal lockable bottle cap 100 formed having at least two parts namely first part and second part. Wherein the first part can be formed of three quartiles such as 1, 2 & 4 of the housing 101 (shown as transparent in the figures for easy explanation) whereas the second part is formed of quartile 3 of the housing 101. Wherein the first part consists of a top portion 30, a skirt 31, and a lip portion 32 that extends radially inward to the first skirt portion 31 provided to hold the cap on the circumference of the bottle 200 opening and the first part is formed to have first concave shape.

Further the second part 3 of the housing 101 is formed of second top portion, second skirt that is extending from the top portion, second skirt, second lip portion provided inward to hold the circumference of the bottle 200 opening and it is formed to have second concave section. Where the first part and second part 3 are combined to form a universal lockable cap 100.

In specific, first part and second part 3 of the housing 101 of the universal lockable cap 100 includes extensions 18, 19 and apertures positioned at least each one on either side. Thereby the extensions fit into the apertures to form a sliding locking mechanism or a first locking mechanism.

Further the exemplary universal locking cap 100 can include a lid 7 that can be open and closed for accessing the contents inside the bottle 200 by means of spring-bias hinge 45. The lid 7 can be opened in response to the authorized signal from the microcontroller based on the biometric sensor input.

Figures 8, 9, 10:
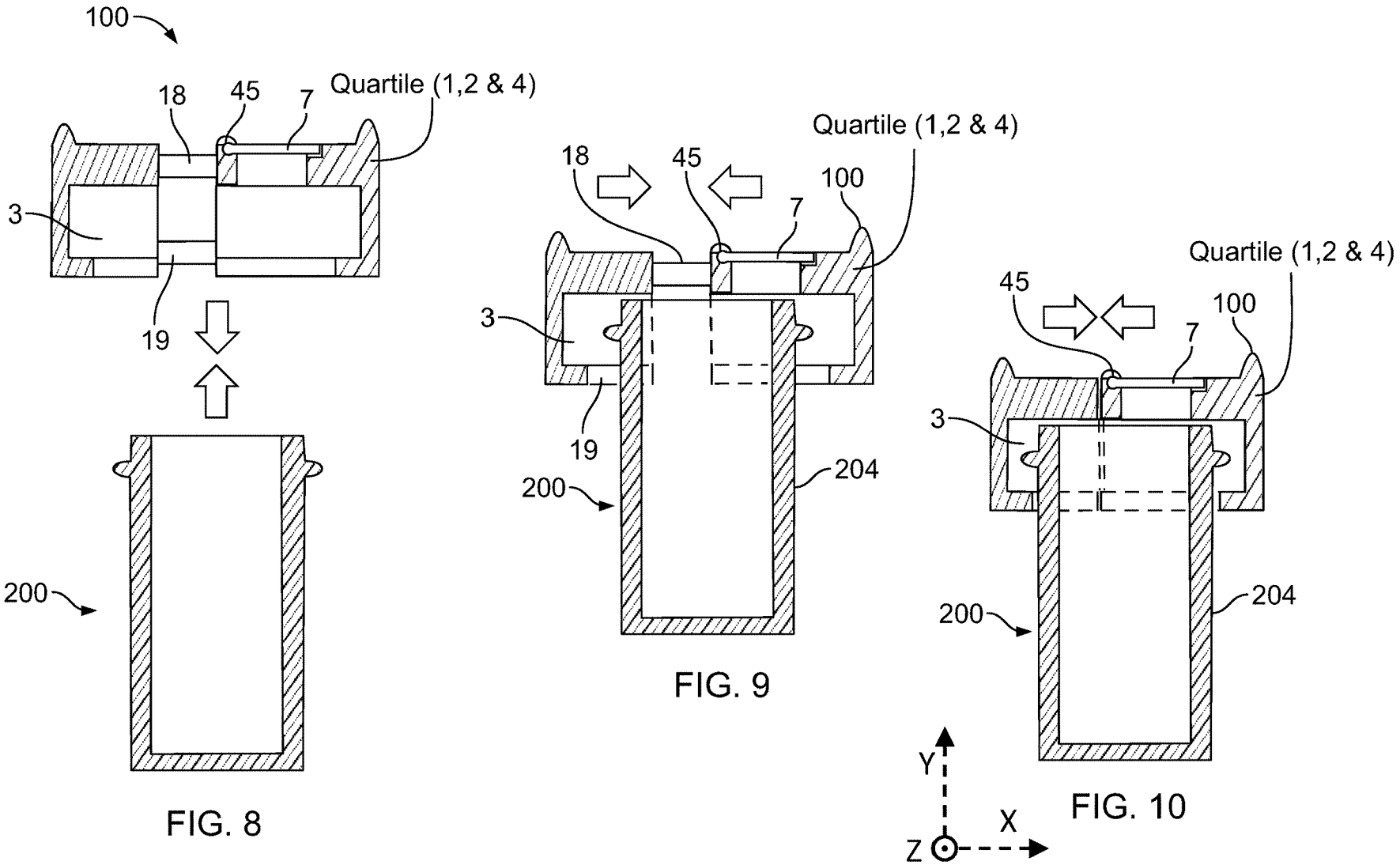
FIG. 8 is a diagram illustrating a relative motion of a cap and bottle embodiment having a sliding locking mechanism in an open position.
FIG. 9 is a diagram illustrating a sliding locking motion of an embodiment.
FIG. 10 is a diagram illustrating an embodiment having a sliding locking mechanism in a closed position around a bottle.

FIG. 8 depicts about a cap 100 and bottle 200 (having protrusion 202) that are in relative motion to each other ready to get assembled to form a closed container 300. The bottle 200 is formed of one or more walls 204 having an opening axially in the Y-axis. The cap 100 is a universal lockable cap that can fit to any kind of bottle 200 irrespective of the size and protrusion 202. The universal lockable bottle cap 100 is provided with biometric access control so that the contents in the container such as pills, liquid, coins, etc. and variations thereof can be only accessed by the authorized individuals based on the biometric input. The retractable lid 7 of the cap 100 is shown in the closed position. The sliding locking mechanism having extension 18, 19 that fit into the apertures on opposite side is shown in the open position.

FIGS. 9 & 10 depict a cap 100 and bottle 200 that are aligned to each other to form a coupling or a first lock. Further the sliding locking mechanism is shown in the open position as the extension 18, 19 are not completely inserted into the apertures to form a lock. Thereafter, a force or pressure is applied to the cap 100 from one end, both ends or internally as shown in FIG. 10 to form a closed container 300. During the pressing or applying of force the two parts of the cap 100 such as first part (1, 2 & 4) and second part 3 are drawn together and coupled to each other. The extensions 18, 19 of the cap 100 axial move into the apertures positioned on the opposite sides and gets locked in the apertures to form a main lock as shown in FIG. 10.

In other embodiments, the extensions 18, 19 can be formed of any materials such as metals, plastic, glass, ceramic, etc. and combinations thereof. In the case of plastic or non-magnetic attracting material, a magnet is positioned either on the tip or covered by a magnetic material. According to the present invention the extension or cylinder 18, 19 can be made up of metal or plastic with magnets attached to it.

In other embodiment of the invention the apertures of the cap 100 can have magnets or electromagnets that can be activated based on the input from the microcontroller positioned on the motherboard 23. Alternatively, the electromagnets can also be automatically activated based on the closing of the extensions 18, 19. For example, some embodiments may employ hollow cylinders. It likewise is not necessary that the two cylinders 18, 19 have circular cross-sections. Indeed, some embodiments may employ rails having square, rectangular, or other non-circular cross-sections. Other embodiments may employ splines, threads, teeth, or other features in the translational interface between the first and second parts of the cap 100

In other embodiment of the invention the extensions or cylinders 18, 19 can be locked within the apertures by means by magnets such as permanent magnets or electromagnets.

Figures 11, 12, 13:
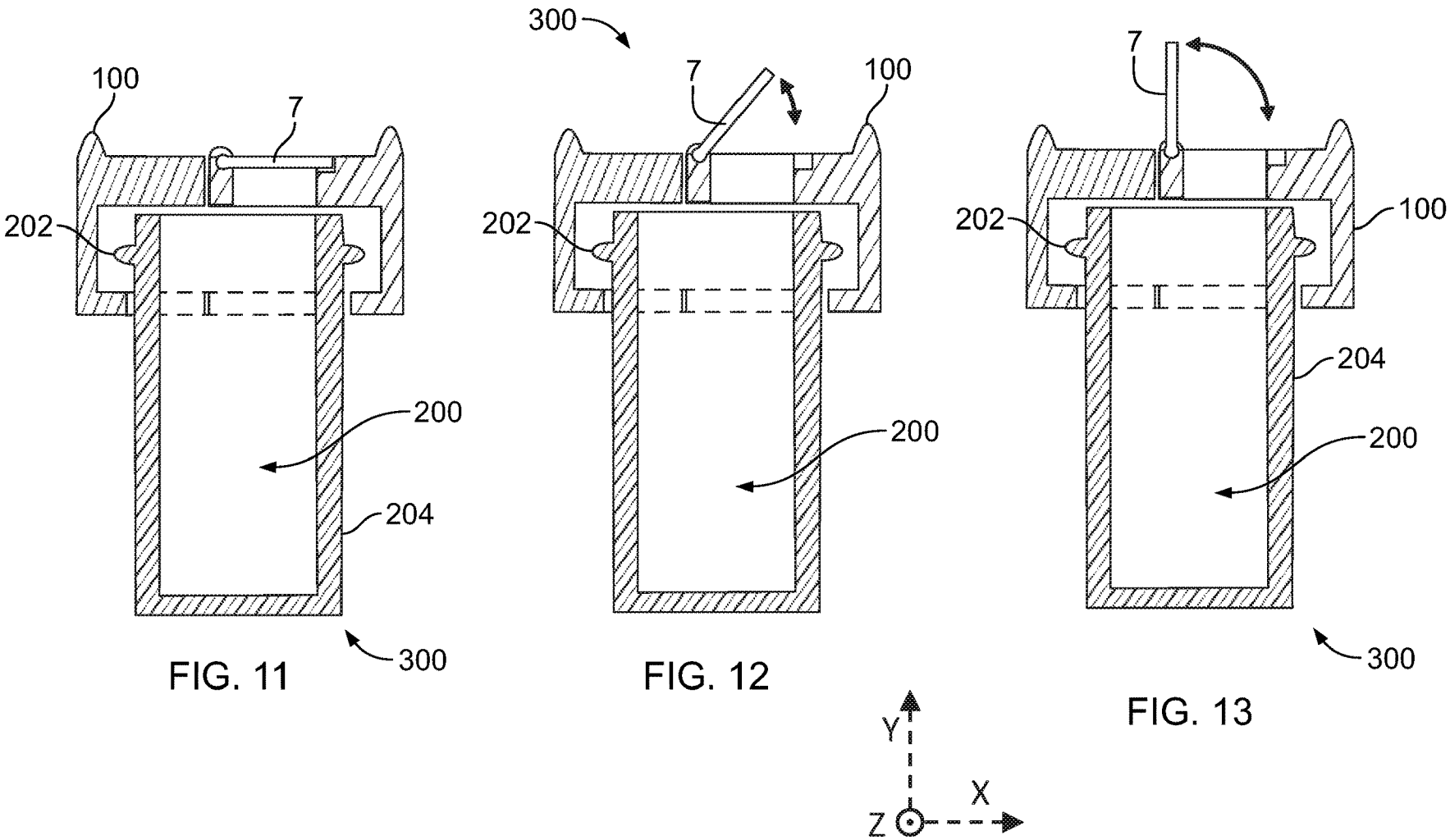
FIG. 11 is a cross-sectional side view of an embodiment having a lid in a closed position.
FIG. 12 is a cross-sectional side view of an embodiment having a lid in an intermediate position.
FIG. 13 is a cross-sectional side view of an embodiment having a lid in an open position.

FIG. 11 depicts a closed container 300 which comprises a bottle 200 with protrusion lugs 202 and universal lockable cap 100 which comprises a biometric sensor 5 and microcontroller positioned on the motherboard 23, notification lights 10, button 15 and button electronics 16. After formation of a closed container 300, the user causes the cap system 100 to save fingerprints or biometric profile information based on the input from the biometric scanner 5 and button 15. Further the notification light 10 is used to indicate the success of saving the biometric profile. In some embodiments, the user can save many fingerprint or other biometric profiles within the electronics of the cap such as over 1000 fingerprint or profiles. The microcontroller is able to distinguish the operation requested by the user based on the number of button 15 presses. For example: 3 continuous presses with 7 seconds indicates the request to disable main/first lock. Further 1 press indicates addition of a fingerprint or profile. Many variations of this button press process are possible for the user interaction with the microcontroller of the cap 100.

Referring generally to FIGS. 12 and 13, according to an embodiment, whenever the user wants to access the contents of the bottle 200 the user has to input his biometric information either through fingerprint, voice recognition, retinal imaging, facial imaging, or the like or combinations thereof. The biometric sensor 5 scans the fingerprint or biometric information of the particular user and sends it to the microcontroller for authorization by comparison to the biometric profiles which are already saved in the memory. After verification, and if the profile is authorized to access, then the microcontroller sends a signal to the motor 11 to disable the second lock by releasing the small protrusion 8 of the lid 7. Which allows the lid 7 to travel from closed position to intermediately position as shown in FIG. 12 and fully open position as shown in FIG. 13 due to spring-bias hinge 45. Further the sliding locking mechanism holding the cap 100 to the bottle 200 is still in the closed position.

In other embodiments, the bottle 200 can be formed of one or more walls 204 to form various containers for example, bottle, vial, package, jar, ampoule, tube, bucket, box, carton or the like.

Furthermore, the universal cap 100 can lock the bottle 200 irrespective of size and shape of the protrusions 202. In some embodiments, the cap 100 locks onto the bottle 200 below the threaded portion of a protrusion 202.

In other embodiment, the biometric sensor 5 can be fingerprint reader, microphone, optical detector or any biometric detection means for fingerprint scanning, voice recognition, retinal imaging, facial recognition, etc.

Further the lid 7 can be closed by applying mechanical pressure which allows the lid 7 to lock. In some embodiments, the seal formed by the lid is a water tight, air-tight or a gas-tight seal.

FIG. 14A to 14C show the bottles 200 from FIG. 7A through 7C with caps attached. Similar to FIGS. 12 & 13, the lids 7 of the caps 100 in FIG. 14 are shown open. FIG. 14A to 14C depict a cross-sectional view of the closed container 300 having a bottle 200 having one or more walls 204 with a protrusion 202 that are used to lock the general caps. Further protrusion 202 shown in FIG. 14 A to 14C represents different configurations such as ridges, continuous threads and lug. Irrespective of the protrusion 202 the universal cap 100 can be configured to lock onto all kind of bottles 200.

In some embodiments, the cap 100 generally has slidable locking mechanism which helps to retract and extend itself based on the size or diameter of the bottle. Alternatively, the cap 100 can tightly hold the circumference of the bottle 200 through means shown, friction or other means. Generally, the lid 7 of the three configurations shown in FIG. 14A to 14C and other configurations are opened based on the received biometric input of the user. Further the protrusion formed on the bottle 200 can be selected from at least one of a continuous thread, lip, lug, bayonet closure, rim, flange, snap fitting and variations thereof.

Figure 15:
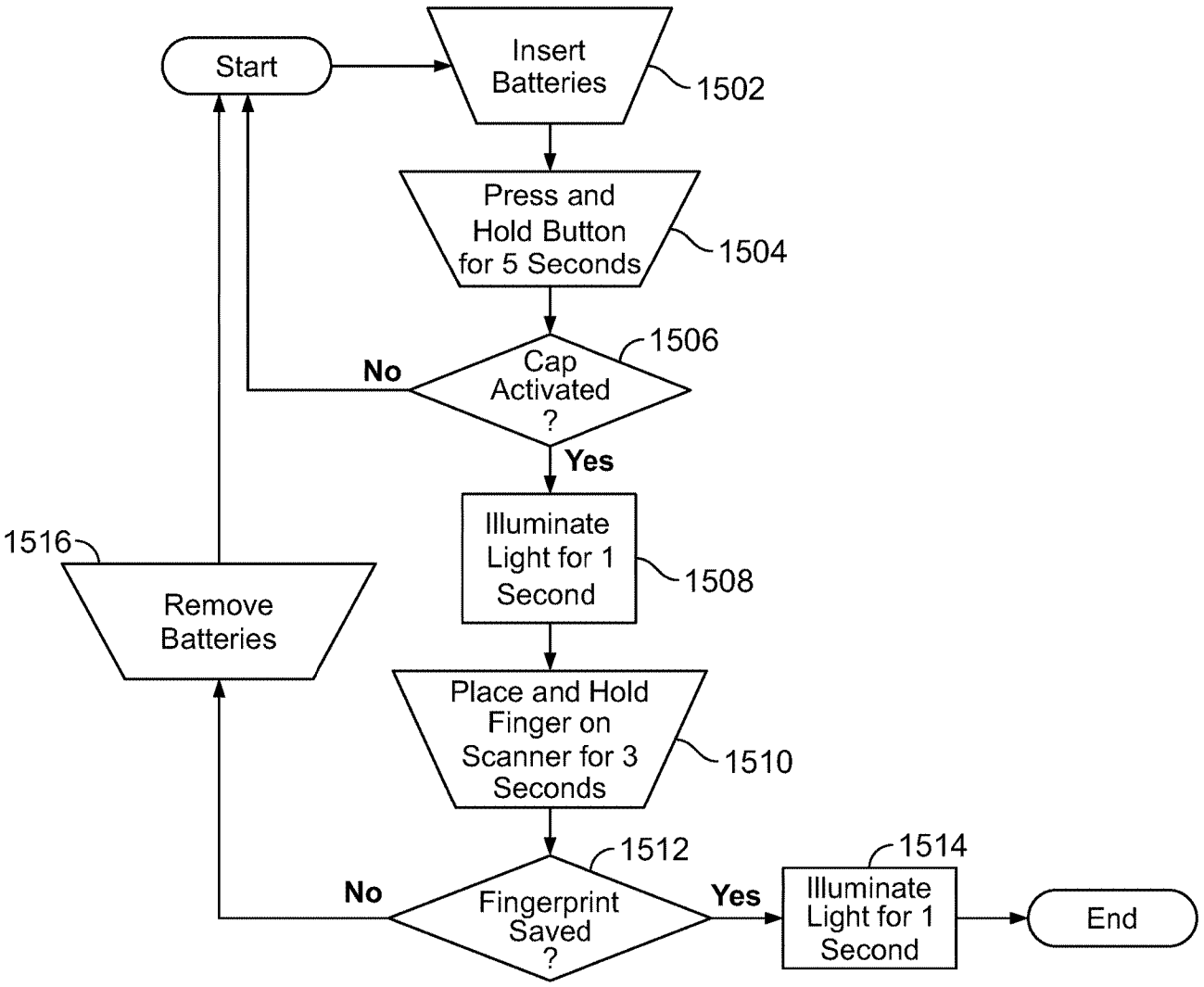
FIG. 15 is a diagram illustrating a user-device interaction for storing a fingerprint according to an embodiment.

A flow diagram of the steps is illustrated in FIG. 15 according an embodiment of the invention. More specifically, the set-up steps after unboxing an universal lockable cap 100 include: insert the batteries 24, 25 into the battery unit 26 (step 1502) located in the quartile 1 of the housing 101 of the cap 100, then press and hold the button 15 positioned on the cap 100 for 5 seconds (step 1504) to activate the cap (step 1506), if it gets activated then there is an illumination of the light 10 for at least 1 second (step 1508). Now if the cap 100 is ready for first fingerprint then the user can place and hold the finger for at least 3 seconds (step 1510) on the biometric sensor 5 to store the fingerprint or profile of the individual for secure access (step 1512) so the scanner can obtain a thorough image of a user fingerprint. Alternatively, if the cap 100 is not activated check/insert the batteries 24, 25 repeat the procedure from step 1502.

Further, when the biometric scanner is done reading the user fingerprint, a feedback in form of light 10 illumination is received for 1 second (step 1514) to indicate the biometric profile is stored successfully. If light 10 does not light up, remove batteries (step 1516) and revert back to Step 1502.

In other embodiment of the invention the fingerprint scanner can be replaced with other biometric sensors.

Figure 16:
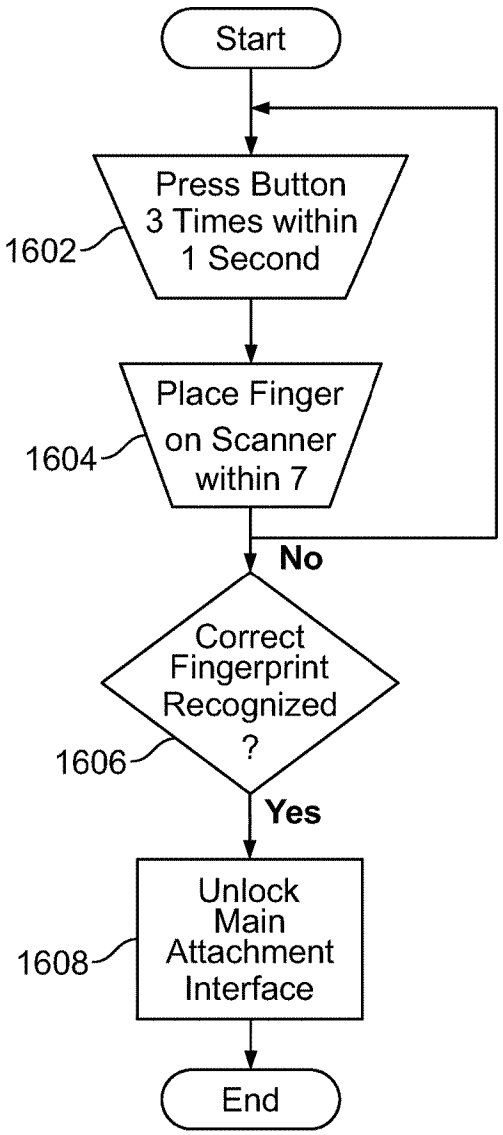
FIG. 16 is a diagram illustrating a user-device interaction for unlocking according to an embodiment.

A flow diagram of the steps is illustrated in FIG. 16 according an embodiment of the invention which unlocks the main attachment to separate the cap 100 from the bottle 200. More specifically the process shown is to press the same button 14 three times such as first button press, second button press and third button press in rapid succession within 1 second (step 1602). Upon completion of the third button press, place the correct fingerprint on the scanner 5 to unlock the cap (step 1604). The microcontroller which can distinguish between the button 10 presses verifies by comparison the biometric sensor 5 input with the saved fingerprint or profile. If the profile is authenticated (step 1606), the small light 10 will illuminate and the main attachment interface is unlocked (step 1608) and the cap 100 can now be removed from the bottle.

When locking the cap onto a bottle 200, simply close the cap around the pill bottle until the magnets come together. A user biometric profile may, if not already in the system, be stored in the cap 100. If light does not light up after storing a biometric profile, remove batteries 1502 or revert back to first step 1602.

Figure 17:
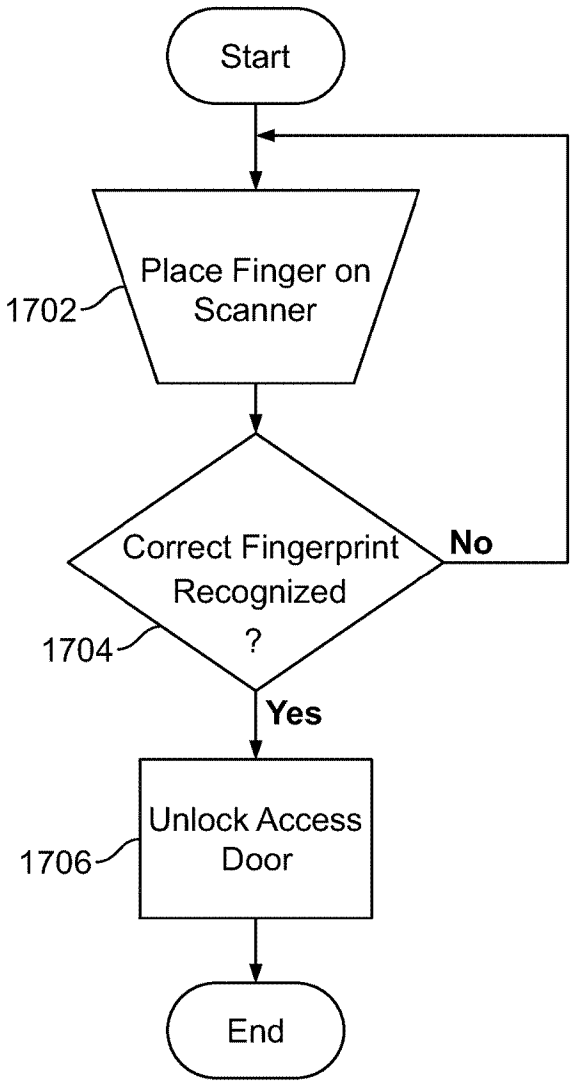
FIG. 17 is a diagram of a user-device interaction process for unlicking a lid or door according to an embodiment.

The flow diagram of the steps illustrated in FIG. 17 depicts a process of opening the lid 7 after a fingerprint is stored comprising of following steps according to an embodiment. Press and hold the finger on the scanner 5 for fingerprint (step 1702) then biometric signal information is forwarded to the microcontroller. Then the microcontroller, present on the motherboard 23, verifies, by comparison, the authorization of the fingerprint with the stored profiles or fingerprints (step 1704). If authorization is verified then microcontroller sends an instruction to second lock means to unlock the lid 7 (step 1706) to allow access to the contents of bottle. If the fingerprint is not verified restart the procedure by placing the finger on the bio-scanner 5.

Figure 18:
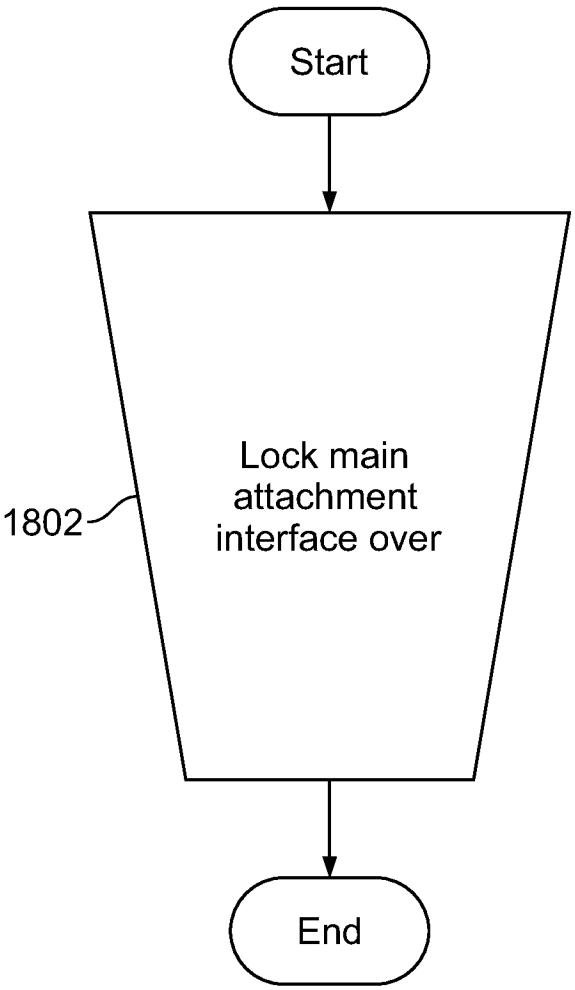
FIG. 18 is a diagram of a user-interface process locking the main attachment according to an embodiment.

The flow diagram of the steps illustrated in FIG. 18 depicts a process of attachment of a cap 100 to a bottle 200 by using the main attachment. To establish the connection, the open position of a cap 100 (sliding locking mechanism) is inserted over a bottle 200. The bottle is inserted into the open cavity of the cap 100 from the underside. After insertion, then force or pressure is applied on at least first and second part of the cap to bring the parts together around the bottle 200. This allow cap 100 to lock onto the bottle by a main or first locking mechanism. This occurs by means of extension 18, 19 which interface with the apertures and then are locked in place by means of magnetic force (step 1802) or other holding and locking mechanism coupling the two parts of the cap 100 onto the bottle 200.

According to any one embodiment of the invention the microprocessor or microcontroller 400 is located on the motherboard 23 and is connected to buttons, readers, illuminating lights, etc. The microcontroller is configured to distinguish what the user is requesting to do based on the button pattern pressed. For example, the microcontroller can distinguish between the user wishing to: (1) unlock the first or main attachment to separate the bottle 200 from the cap 100, (2) updating of fingerprints such as addition or deletion of a user profile based on a user requirement or (3) unlock a second lock such as a lid.

In an embodiment of the invention the universal cap 100 has a means to detect a deviation from the prescribed medication dosing regimen. For various ways and steps may be used to detect a deviation. For example, by measuring the weight or weight-ratio of the dosage of the medications available in the pill bottle before and also after accessed using the lid 7. Also, the system may store the tables of dosage of medications prescribed by the doctor or consultant or by user for comparison. Further, a storing means that records the opening of the lid for dispensing the medication based on the input from biometric sensor can be used for monitoring medication dosing. Further, the system calculates the amount of drug that has been accessed by the person and it indicates and provides this information to the microcontroller 400.

The microcontroller 400 correlates the information and compares the data from the stored tables to the drug accessed after opening of the lid and determines if any deviation from the proper dosing (such as increased or decreased drug accessing). Afterwards, the user is notified by means of different indicating means such as display or any based on the user requirement. Also, notice can be sent to others through a transmitter accessory. The transmitter may transmit to an intermediary device such as home hub network using Zygbee mesh communications. The home hub network can then communicate to others, such as Doctors or Pharmacists, via other telecommunications means.

The amount of drugs in the pill bottle can be input either while filling the bottle with medications or can be determined in real-time using a mechanism to calculate the weight/amount of the pills in the bottle 200. Further, the amount of drugs dispensed can be calculated by conventional arrangement that can be positioned in the cap by allowing one pill and calculating the frequency of the pills accessed from the lid 7 or by using any other mechanism to calculate the drug out/in.

The system according to the above-mentioned embodiment can have a means to verify or display who accessed the drug by using their biometric information and storing such information in a memory device.

According to one embodiment of the invention the cap can include a clock to store the dosage with time stamps or a counter to calculate the frequency of lid opening and drug accessing.

According to other embodiments of the invention the cap 100 can have a means to alert of a deviation. In other words, when the system detect the deviation from the prescribed dosage regimen, for example whenever there is there is deviation or change in the amount of drug that was dispensed for medication (that can be higher or lower than the prescribed dosage of the drug) the system alerts the user through different means such as buzzer, display or visual indication, through sending a text SMS, or other means.

The cap 100 includes a biometric sensor 5 which senses the user request or user input for opening of the lid for drug access. Following, the biometric sensor 5 sends the user's response to the microprocessor/microcontroller 400 positioned on the motherboard 23. If the microprocessor/microcontroller verifies the fingerprint, it signals for providing access or opening of the lid 7. Further, the microprocessor/controller can be can be connected to accessories such as a clock or a counter (not specifically shown) which stores or calculates the frequency or time the lid 7 is accessed and stores such information in the memory. In addition, or alternatively, it can transmit the data offsite using the transmitter and intermediary devices as needed. During the lid 7 access, the cap 100 can read the weight or amount or size of the drug (or medication or contents) accessed through the lid 7. The cap system can then correlate that information with the prescribed drug dosage. Whenever there is a more than negligible change in the dosage (up or down) the microcontroller or microprocessor 400 on the motherboard 23 instructs the indicating means to send a warning to the user.

In another embodiment of the invention the cap 100 has a capability to correlate the plurality of dosages of a plurality of medications to respective weight-related values indicative of proper dosage for a given patient. In specific, the system has capability to calculate the dosage being taken of different medications based on the weight of the pills. For this embodiment, a sensor is used which can weigh the bottle 200 when empty, when filled and after each lid opening for dispensing.

In another embodiment of the invention, a clock used is to provide a timestamp whenever the lid 7 is accessed. Further, it can be used to verify the dosage timings accurately for every opening for example morning, afternoon, evening and night dosage regime. Thus, the cap 100 system can compare the dispensed timestamps with the exact prescribed dosage. This reduces any reliance on any assumption or averaging for the day.

A counter program is used by microcontroller 400 of the cap system 100 to calculate the number of times the lid 7 is accessed. The counter is useful to calculate the average daily dosage regime with the expected dosage regime.

According to other embodiment of the invention the microcontroller 400 stores the complete history of the amount of drug accessed during each lid 7 opening along with the fingerprint identification and time stamp for accurate analysis.

According to other embodiment of the invention the closed container 300 comprising of cap 100 and bottle 200 have a restrict means (not shown) which only allow a certain amount of drug to dispense based on the prescribed dosage regimen instead of accessing the whole bottle of the drug. Alternatively, the microcontroller 400 has an override feature which allows full drug access if a special request is made.

According to other embodiment of the invention the cap 100 can have a calculating means which weighs the amount of drugs before and after an access. Further, the calculating means can use size of the pills (medication drug) accessed out/in to find the deviation of drug from a prescribed regimen. Alternatively, the initial drug size or weight can be fed to the microcontroller of the motherboard 203 either by user input or any conventional weight measuring means that can be installed in the bottle 200 or cap 100.

According to other embodiment of the invention the cap 100 can include a transmitter to send the data collected to offsite location.

The cap 100 has a data collection/storage 500 aspect that is able to relay information to the prescribing doctor or pharmacist in an effort to better prescribe medication based on the patient's ability to adhere to dosing and time requirements. Also, the cap can have a short message service (SMS) capability alerting the user by text when it is time to take a dose.

According to other embodiment of the invention the cap 100 can attached with clock have a capability to remind the user about the dosage intake timings/interval. Which prevents the user from skipping his dosage intervals and allow the user to have the medications on time.

For dosage regime reminder the cap 100 is already provided with the doctors prescribed regime which can include quantity, time intervals etc.

The cap 100 of the present invention can be interchangeable to any bottle and has the means to delete or add fingerprints.

Figure 19:
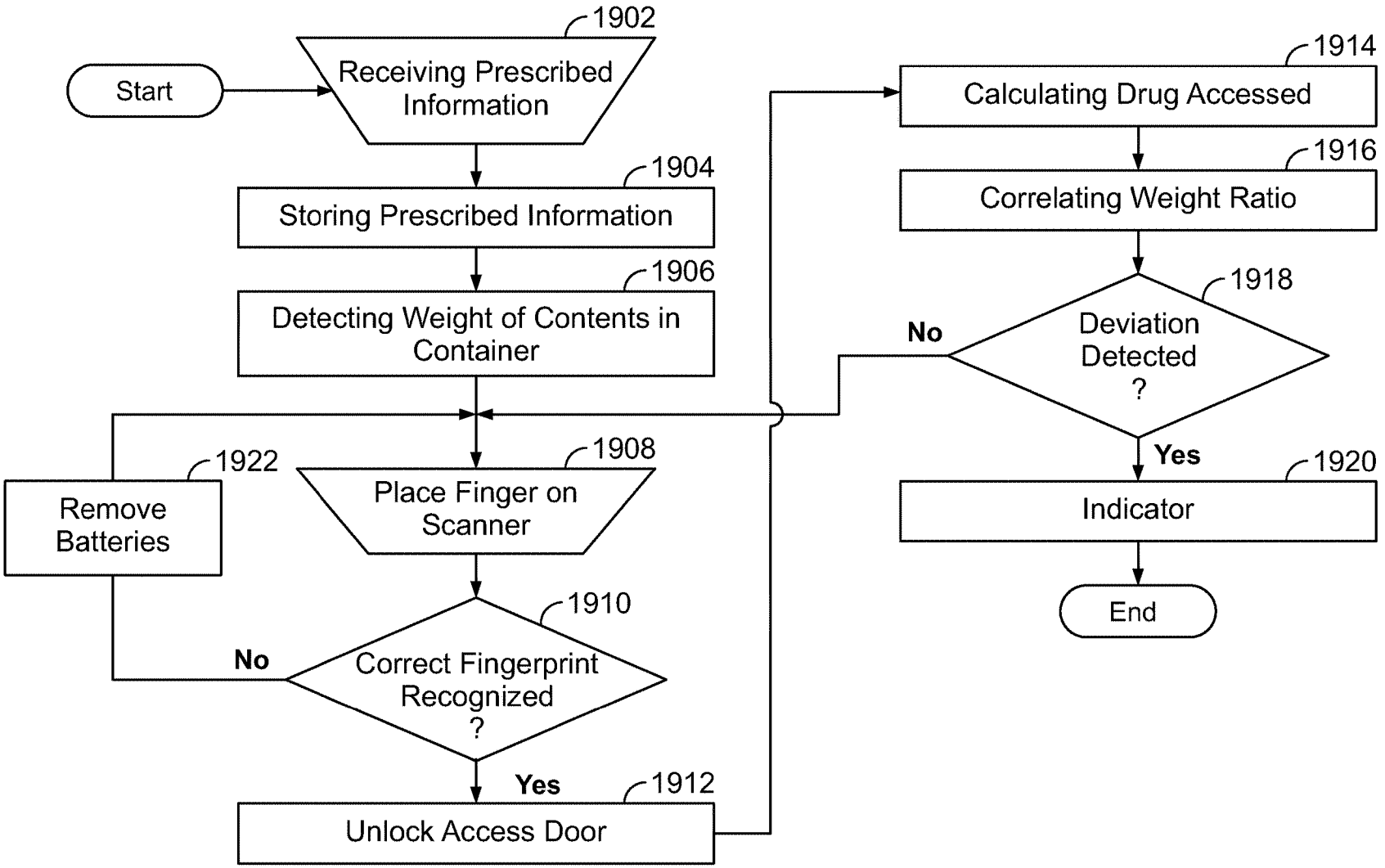
FIG. 19 is a diagram of a system process according to one embodiment of the invention for detecting deviation in use of container.

An exemplary flow diagram of the steps for detecting deviation from a prescription dosage is illustrated in FIG. 19. In particular, FIG. 19 depicts a process of detecting deviation of prescribed drug dosage regimen based on weight. In other embodiments, volume and a sonar sensor pointed down into the bottle from the cap 100 may be used.

The cap 100 receives the prescribed drug dosage regimen (step 1902) from either a doctor or from any concerned person and this information can be either inputted into the cap 100 manually or by using a receiver that receives the data from the offsite location or by any contactless transfer means. The prescribed dosage information that is collected is stored in the data storage unit 500 (step 1904). The data storage unit 500 can be either a microcontroller or a separate memory unit that allows the system to receive and store information for different purposes. Further, the data storage unit 500 can be accessed by the microcontroller 400. After storing the dosage data, accessories means 600 such as conventional pressure sensor, weight sensor, infrared sensor, sonar sensor, etc. and variations thereof positioned underside of the cap 100 can be used. These accessory 600 sensors can detect the actual weight or volume of the contents positioned in the bottle 200 (step 1906) and update the same information to the microcontroller 400. This weight and/or volume information or can also be stored in the data storage unit 500.

When a user desires to access the content inside the bottle 200, the user can use the biometric sensor. In this embodiment the user places and holds (step 1908) a finger on the scanner 5 to create a fingerprint biometric signal of information. This biometric information is forwarded to and received by the microcontroller 400. The microcontroller 400 compares the fingerprint and verifies the authorization of the user with the fingerprint (whether the fingerprint is correct or not (step 1910)). This biometric comparison is made by comparing with the stored profiles or fingerprints. If the fingerprint scan doesn't function or is not verified/correct a possible next step is to remove the batteries (step 1922) and proceed to reinitialize the procedure. Afterwards, the process is restarted by placing a finger on the scanner (step 1908). If authorization is verified then microcontroller sends an instruction to the second lock means to unlock the door or lid 7 (step 1912) and allow access the contents of bottle 200. After accessing the lid 7, the weight (and or volume) of the contents that remain are again determined (step 1914). This information is sent to the microcontroller 400 which correlates the drug access with prescribed dosage regiment (mentioned in step 1902) and calculates the weight ratio of between them (step 1916) and calculates the deviation between the dispensed medication and the prescribed dosage (1918). If there is a non-negligible difference measured then microcontroller 400 in the cap 100 provides an indicator (step 1920) to the user of a deviation and also updates the present weight in the data storage unit 500. If a negligible deviation occurs the system ignores the error and updates the present weight in the data storage 500 and waits for the next session.

The cap 100 of the above embodiment can be provided with a clock or counter positioned to it to compare the time interval with prescribed dosage and the amount of drug accessed for the same time interval.

The cap 100 is able to detect the amount of drug accessed based on the weight, size or volume. In some embodiments, weight or size can be calculated even during drug dispensing or access when the bottle 200 is positioned in slanted or inverted position.

The dosage deviation can be calculated after every opening of the door or lid 7 of the cap or per day by taking average dosage regimen.

In another embodiment of the invention, for the initialization, the weight of the contents can be input by user or the bottle has to be inverted for the first time to update the weight in the data storage unit 500. A volume sensor, such as a sonar sensor, can be used when the bottle is in an upright position.

Figure 20:
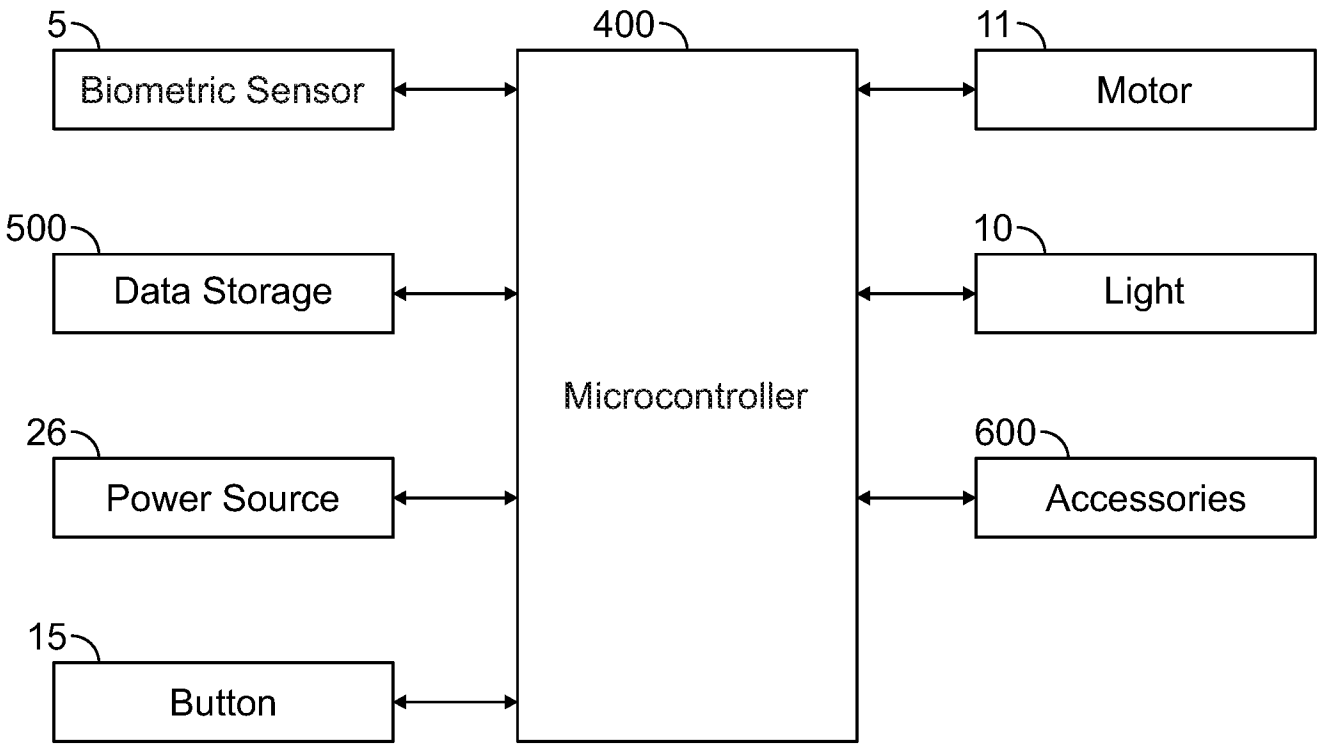
FIG. 20 is a block diagram of an embodiment with a microcontroller and electronics, where the microcontroller and the electronic components are interconnected.

FIG. 20 is a block diagram which shows about important electronics devices that connected to the microcontroller 400. The electronic devices allow for input and output of data. In specific, a microcontroller 400 is connected to a biometric sensor 5 for reading biometric information such as fingerprint, voice recognition, facial recognition/expression, etc. This biometric information may be stored in the data collection/storage unit 500. Further the data storage unit can store a variety of information such as time stamp and prescribed dosage regimen suggested by the doctor or concerned person, history of the amount of drug accessed by each user profile including with time stamps. A power source 26 is used by the electronics of the cap. The power source 26 is used to activate the cap by means of batteries 24, 25 or by an external power source. Button 15 is positioned on the cap 100, where the microcontroller 400 can distinguish the input based on the number of clicks or press for different operations. The motor 11 can be coupled to microcontroller 400. The motor 11 is able to physically control the lid 7 based on instructions from the microcontroller 400. Generally, inputs from the biometric sensor 5 are used by the microprocessor to determine when to open the lid. Light 10 is connected to the microcontroller 400 and receives the instructions from it to illuminate the light 10 for specific time period for example 1 second to acts as a visual feedback and interact with the user. Further the microcontroller 400 can have multiple accessories such as transmitter, weight sensor, pressure sensor, sonar sensor, etc. which can receive or send information to the microcontroller 400 for effective operation.

Below is a detailed description of the electronic components and parts that may be used with the embodiments. The parts include a microprocessor 400, biometric scanner 5, data storage 500, motor 11, light 10, data storage 500, power source 26, button 15 and various accessories 600.

Electronics

Biometric Scanner—Fingerprint Scanner

The fingerprint scanner 5 encompasses the area represented by the square located within the slanted guarding 6 located around three of the four sides surrounding the area where the biometric scanner 5 will be situated. The area located within the large rectangular prism that the fingerprint scanner sits atop is open space that houses internal electronics. In some embodiments, the scanner 5 can be relatively low cost. An optical scanner 5 may be inexpensive in comparison to other systems; however, as described elsewhere, potential biometric scanners 5 are not limited to this bio-recognition system.

Data Storage

The storage system 500 may hold the data for all the components within the cap that require some data storage 500. This includes computer code that may direct the microcontroller/microprocessor's actions and the data of the saved biometrics or fingerprints. In some embodiments, the number of times the cap is opened is stored. In some embodiments, a clock is implemented by the microprocessor or as an accessory in the cap and time stamps are stored. In some embodiments, the date and time when the cap is opened are stored. In some embodiments the number of times the cap is opened, and the frequency of openings are tracked and the data obtained is transmitted or stored off-site. Dosage regimes may be stored in memory. Weight and volume of the contents may be stored in memory.

Power Source

Dimensions:

Length: 1.15 cm

Width: 0.8 cm

Height: 0.6 cm

A power source 26 is used to power the electronics of the cap 100. Possible dimensions for a power source 26 are provided above. The power source 26 supplies power to the microcontroller/microprocessor 400, one or more motors 11 running the locking mechanisms, the button 15, and, in some embodiments, a light 10. Replaceable batteries 24, 25 may be used. Recharging capabilities may also be employed. In some embodiments, a section of the cap 100 that is a lithium-ion battery 24, 25 is capable of holding charge long enough to service an entire prescription, and then may be recharged between prescriptions. In some embodiments, an external power supply may be used to charge a battery enclosed in the bottle or to directly power the electrical and electronic components of the cap 100. The power source may also be used to maintain magnet charge on items such as magnets in the cap 100. Recharging of the power source may be accomplished without a physical connection to the cap 100.

Motor

Various motors may be used with the various embodiments of the cap 100. A push-pull type motor 11 or actuator or a conventional motor may be utilized in the design. Designs may implement multiple locking mechanisms. A single motor may be responsible for unlocking both the lid 7 (e.g., semicircle lid) and the entire cap 100. If a push-pull type actuator is used then the protruding arm may rest at half of its stroke length and then extend fully to unlock the entire cap from the bottle 200 and retract entirely to unlock the mechanism holding the semicircle lid on top in place. If a conventional rotational motor is utilized, then a motor having a vertically oriented rotor or shaft may be used. Counterclockwise rotation may unlock the semicircle lid, and then return to its vertical resting position. If the motor turns clockwise, then the entire cap may be unlocked. Both locking mechanisms may use a latch type system where motor use will only be necessary for unlocking. When the system relocks, it may utilize a latch-like assembly where the pressure applied by the locking arm when moving into its locked position is enough to push the lock back far enough so that the locking arm can then be caught by a tooth of the locking piece. Multiple motors may be used.

Button

The button 15 may take various forms, for example, a contact button and a physical button. A switch may also be substituted for the button 15. In one embodiment, the button 15 is be located on the underside of the trapezoidal prism located on the haft opposite the side on which the fingerprint scanner 5 is located. The button 15 is electrically connected to microcontroller 400 and its purpose is to signal the microprocessor/controller 400 instructions, for example, when the entire cap 100 is to be opened, when the first fingerprint is being saved, and when successive fingerprints are to be saved. In one embodiment, a series of button clicks or depressions may be used to instruct the microprocessor, for example, three clicks of the button within a 1-second time interval may be used to tell the program running on the microcontroller/microprocessor that if the correct fingerprint is placed upon the scanner within the next 7 seconds that the motor is to be turned counterclockwise to open the entire cap. If the correct fingerprint is not placed upon the scanner 5 within the 7-second time interval or if three unsuccessful attempts within the interval occur, then the program is to revert back to its base function which is to turn the motor 11 in the clockwise direction to open the lid when the correct fingerprint is recognized.

In one embodiment, to input the initial fingerprint, the user may press and hold the button down for 5 seconds, the light 10 will flash letting the user know that his or her fingerprint can now be placed upon the scanner 5. To input fingerprints after the first one, users must press and hold the button down for a duration of 3 seconds and then the light will flash signaling that the system is ready to read and save a new fingerprint. Different sequences and time durations may be used for the user to interact with the microcontroller through a button.

Light

A light 10 is used by the cap 100 to communicate with the user. In one embodiment, a light 10 may be provided to notify the user when a state of charge of the power supply is extremely low and when a new fingerprint is ready to be inputted. The light may be illuminated when the power source is at such a low level that there is only enough power for one more turn (or a predetermined small number of turns) of the motor in either direction. The light also may be illuminated when the cap is ready to read the initial fingerprint and when the user has followed the correct prompts necessary to input successive fingerprints. Many variations of the light sequences may be used to communicate with the user. These other uses of the light to communicate are included in this disclosure.

Microprocessor

Preferably, the microprocessor is small enough to easily fit into a cap 100. The microprocessor is preferably connected to the other electronic parts either directly or indirectly, including memory, buttons, motor and lights.

The large rectangular area within the cap represents the space partitioned for the internal electronics. In one embodiment, the microprocessor sits within the rectangular area and is located on the cap's motherboard.

The microcontroller/microprocessor 400 may be programmed (e.g., by hardware and/or software) to perform various functions including the following:

A. Move the information acquired from the live biometric scanner 5 when a fingerprint is scanned to both:

1. a result generator: so it can be matched up with the correct fingerprint data supplied by the memory, and 2. a memory bank: so new fingerprint data can be saved when instructed;

B. Move the information regarding the correct fingerprint data from the memory bank to the result generator so it can be matched up with the fingerprint data supplied by the live biometric;

C. Signal for the unlocking of either the semicircle lid on top of the cap or signal for the unlocking of the sliding locking mechanism keeping the cap on the bottle by connecting the result generator results to either of the locking mechanisms when the fingerprint data from the live biometric matches up with the saved fingerprint data supplied by the memory bank which is determined by the result generator; and D. Recognize when the button on the cap is clicked three times within one second wherein if the correct fingerprint is placed upon the scanner any time within the next seven seconds following the third click of the button, then the sliding locking mechanism holding the cap on the bottle is to be unlocked and if the seven seconds elapse and the correct fingerprint is not recognized, then the system is to revert back to its primary function which instructs the result generator to signal the unlocking of the semicircle lid on top of the cap upon receiving and recognizing an authorized live biometric.

Various accessories 600 may be included in the cap 100 as noted elsewhere. A transmitter may be included in the cap 100 so that the cap 100 may communicate with other electronics such as a smart phone, tablet, home hub, home appliance, security system, life alert system, computer, etc. This transmitter communication can be through any wired or wireless means such as WiFi, blue-tooth, cellular, mesh network (e.g. Zygbee), etc. The transmitter may communicate directly with a computer, through a home hub, or through other intermediary devices. The cap 100 may communicate directly or indirectly with off-site locations or a computer on site. The cap 100 may communicate with a medical office, pharmacist or the like.

User Manual

An example of user manual instructing on the use of a programmed cap 100 follows. Upon opening and unboxing your new SmartCap:

Step 1: Insert the batteries into battery slots.

TAKE NOTE: READ THE FOLLOWING STEPS THROUGH BEFORE PERFORMING THEM!

Step 2: To activate the cap, press and hold the small colored button for 5 seconds.

*A small light will illuminate notifying the user that the cap has been successfully activated.

The cap is now ready to read the first fingerprint.

Step 3: To store the first fingerprint, place your fingerprint on the face of the scanner and hold it there for 3 seconds so the scanner can get a thorough image of your fingerprint. When the biometric scanner is done reading your print, the light will illuminate notifying you that your fingerprint has been successfully saved. If light does not light up, remove batteries and revert back to Step 1.

Step 4: In order to unlock the cap from its locked position (from itself), so it can be placed on a pill bottle, press the same button three times in rapid succession. Upon completion of the third click, place the correct fingerprint on the scanner to unlock the cap. The small light will illuminate and the cap can now be opened. When locking the cap onto a pill bottle, simply close the cap around the pill bottle until the magnets come together. Repeat this step any time you need to remove the pill bottle cap from a pill bottle.

Step 5: To save new fingerprints after the initial fingerprint storage, press and hold the button for 3 seconds. The small light will illuminate briefly notifying you the cap is ready to receive the new fingerprint, and follow step 3 to save the additional fingerprint.

While a presently preferred and various alternative embodiments of the present general inventive concept have been described in sufficient detail above to enable a person skilled in the relevant art to make and use the same it should be obvious that various other adaptations and modifications can be envisioned by those persons skilled in such art without departing from either the spirit of the present general inventive concept or the scope of the appended claims.

We claim:

1. A universal lockable bottle cap with biometric access control, said lockable cap capable of engaging a bottle comprising:

a first part including;

a first top portion, a first skirt portion extending from the first top portion along an axis of the cap, and a first lip portion extending radially inward from the first skirt portion such that the first top portion, the first skirt portion, and the first lip portion form a first concave section;

a second part including;

a second top portion, a second skirt portion extending from the second top portion along the axis of the cap, and a second lip portion extending radially inward from the second skirt portion such that the second top portion, the second skirt portion, and the second lip portion form a second concave section:

a third part extending laterally between the first part and the second part to permit relative lateral translation of the first and second parts between a retracted position and an extended position, wherein, in the retracted position the first and second parts are proximal to one another, and wherein, in the extended position the first and second parts are spaced apart from one another compared to the retracted position;

a first lock to selectively restrict the lateral translation of the first and second parts;

an aperture in at least one of the first and second top portions, the aperture extending through the cap in axial direction;

a lid connected to at least one of the first and second parts, the lid being movable between a closed position and an open position, wherein, in the closed position the lid covers a passage through the aperture and in the open position the lid uncovers the passage through the aperture; and a second lock to selectively restrict movement of the lid;

a biometric sensor attached to at least one of the first and second parts; and a microcontroller coupled to the biometric sensor, the first lock, and the second lock;

the microcontroller being configured to receive a first biometric information from the biometric sensor and, in response, to unlock the first lock; and the microcontroller being configured to receive a second biometric information from the biometric sensor and, in response, to unlock the second lock.

2. The lockable bottle cap of claim 1, further comprising:

a button;

the microcontroller being coupled to the button;

the microcontroller being configured to receive a first button press information from the button and, in response, to determine the first biometric information;

the microcontroller being configured to receive a second button press information from the button and, in response, to determine the second biometric information; and the microcontroller being configured to receive a third button press information from the button and, in response, to determine the third biometric information.

3. The lockable bottle cap of claim 2, further comprising:

the microcontroller being configured to perform a comparison of biometric information using the received biometric information.

4. The lockable bottle cap of claim 1, wherein the biometric sensor includes at least one of a fingerprint reader, microphone or any biometric detection means, for fingerprint scanning, voice recognition, retinal imaging, facial recognition.

5. The lockable bottle cap of claim 1, wherein the cap can be formed of more than two moving parts and wherein the aperture is configured to dispense medication from a capped bottle.

6. A closable container comprising:

one or more walls forming an opening in an axial direction to a volume enclosed by the one or more walls;

a protrusion extending from the one or more walls in a radial direction relative to the axis of the opening; and a cap with biometric control to access content of the closable container; wherein the cap comprises;

a first part;

a second part;

wherein the first and second part include extensions and apertures to permit relative lateral translation of the first and second parts between a retracted position and an extended position;

a first lock to selectively restrict the lateral translation of the first and second parts;

a lid connected to at least one of the first and second parts, the lid being movable between a closed position and an open position, wherein, in the closed position the lid covers a passage through an aperture and in the open position the lid uncovers the passage through the aperture; and a second lock to selectively restrict movement of the lid;

a biometric sensor attached to at least one of the first and second parts; and a microcontroller coupled to the biometric sensor, the first lock, and the second lock;

the microcontroller being configured to receive first biometric information from the biometric sensor and, in response, to unlock the first lock; and the microcontroller being configured to receive second biometric information from the biometric sensor and, in response, to unlock the second lock.

7. The closable container of claim 6, wherein; the first and second part of the cap includes;

a top portion, a skirt portion extending from the top portion along an, axis of the cap, and a lip portion extending radially inward from the skirt portion such that the top portion, the skirt portion, and the lip portion form a concave section.

8. The closable container of claim 6, wherein the radial protrusion includes one or more of:

a continuous thread;

a lip;

a lug;

a bayonet closure;

a rim;
a flange; and
a snap fitting.

9. The closable container of claim 6, wherein the one or more walls form at least one of:
a vial;
a package;
ajar;
an ampoule;
a tube;
a bucket;
a bottle;
a box; and
a carton.

10. The closable container of claim 6, wherein the biometric sensor comprises one or more of a microphone, an optical detector and a fingerprint reader.

11. The closable container of claim 6, wherein the process to open the container comprises:
receiving a finger on a fingerprint sensor;
determining the first biometric information from the finger by the fingerprint sensor;
providing the first biometric information to the microcontroller;
comparing the first biometric information to a stored fingerprint information by the microcontroller; and
unlocking a lock using the microcontroller when the first biometric information matches the stored fingerprint information.

12. The closable container of claim 6, wherein the cap of the container includes:
a button;
wherein the button is coupled to the microcontroller; and
the microcontroller is configured to receive a first button press information from the button and, in response, to determine the first biometric information;
the microcontroller is configured to receive a second button press information from the button and, in response, to determine the second biometric information; and
the microcontroller is configured to receive a third button press information from the button and, in response, to determine a third biometric information.

13. The closable container of claim 12, further comprising:
the microcontroller being configured to determine a process to use based on the received button press information.

14. A method for detecting a deviation from a prescribed dosing regimen, the method comprising:
(a) correlating and storing plurality of dosages of a plurality of medications including respective weight related or volume related values indicative of the proper dosage of medication for a given patient;
(b) recording an opening of a lid for dispensing medication using a biometric sensor;
(c) calculating a weight ratio or a volume ratio of the medication after opening the lid;
(d) providing a dosing system which uses a microcontroller and determines a dose of the medication after opening the lid;
(e) alerting the user upon detecting, a deviation from a prescribed dosage regimen.

15. The method of claim 14, wherein the dosage deviation is calculated based on one or more of: counting every lid opening, a sonar sensor input and an average daily dosage regimen.

16. The method of claim 14, wherein the microcontroller stores a history of amount of a drug accessed with a biometric signature or a name for later verification.

17. The method of claim 14, further comprising transmitting data using a cap with a data transmitter.

18. The method of claim 14, further comprises storing data using a memory.

19. The method of claim 14, further comprising calculating a frequency of the lid opening, wherein a clock or counter is used to calculate the frequency of the lid opening.

20. The method of claim 14, further comprising determining an amount of a drug dispensed based on a weight, a volume or a size.

21. The method of claim 14 further comprising:
determining a weight ratio or a volume ratio of the medication before the medication is accessed using the lid; and
comparing the determined weight ratio or the determined volume ratio from before the medication is accessed using the lid with the calculated weight ratio or the calculated volume ratio after opening the lid.

* * * * *